US011684945B2

(12) United States Patent
Boo et al.

(10) Patent No.: US 11,684,945 B2
(45) Date of Patent: Jun. 27, 2023

(54) DISPENSING SYSTEM

(71) Applicant: NSW Automation Sdn. Bhd., Penang (MY)

(72) Inventors: Kiang Ngee Boo, Penang (MY); Kiang Seng Boo, Penang (MY); Kian Chong Tai, Penang (MY); Chin Hui Toh, Penang (MY)

(73) Assignee: NSW AUTOMATION SDN. BHD., Penang (MY)

( * ) Notice: Subject to any disclaimer, the term of this patent is extended or adjusted under 35 U.S.C. 154(b) by 0 days.

(21) Appl. No.: 16/907,226

(22) Filed: Jun. 20, 2020

(65) Prior Publication Data

US 2021/0394226 A1 Dec. 23, 2021

(51) Int. Cl.
*B05C 5/02* (2006.01)
*B05C 11/10* (2006.01)

(52) U.S. Cl.
CPC ..... *B05C 11/1002* (2013.01); *B05C 5/0225* (2013.01)

(58) Field of Classification Search
CPC . B05C 11/10; B05C 11/1034; B05C 11/1002; B05C 11/1013; B05C 11/1042; B05C 5/0212; B05C 5/0237; B05C 5/0225; B05C 5/001; B05C 5/0216
USPC ..... 222/163–167, 146.5, 309, 504
See application file for complete search history.

(56) References Cited

U.S. PATENT DOCUMENTS 1,935,857 A 11/1933 Nachumsohn
2,681,485 A 6/1954 Smith
3,544,522 A * 12/1970 Hahn ..... B01F 9/06 528/288
4,046,145 A 9/1977 Choksi et al.
4,974,755 A * 12/1990 Sonntag ..... G01F 11/021 251/319
7,896,200 B2 * 3/2011 Nakatsuji ..... B05C 11/10 222/165
7,980,197 B2 * 7/2011 Prentice ..... H01L 21/6715 118/688
8,136,705 B2 * 3/2012 Tracy ..... F04B 17/03 222/311

(Continued)

FOREIGN PATENT DOCUMENTS

CN 2547697 Y 4/2003
CN 101511491 A 8/2009

(Continued)

OTHER PUBLICATIONS

Fond et al., Characterisation of dispersed phosphor particles for quantitative photoluminescence measurements, Optical Materials 89 (2019) 615-622 (8 pages).

(Continued)

*Primary Examiner* — Charles P. Cheyney
(74) *Attorney, Agent, or Firm* — Brian J. Pangrle

(57) ABSTRACT

A dispensing system can include a material delivery assembly that includes a tubular reservoir with a tubular extension, where the tubular reservoir includes a longitudinal axis; a nozzle body, where the tubular extension fluidly couples the tubular reservoir to the nozzle body; and a rotor coupling that operatively couples to the material delivery assembly for rotation of the tubular reservoir about its longitudinal axis.

20 Claims, 12 Drawing Sheets

(56) References Cited

U.S. PATENT DOCUMENTS

| | | | | |
|---|---|---|---|---|
| 8,302,821 | B2 * | 11/2012 | Inaba | H01L 21/67144 222/413 |
| 8,662,352 | B1 * | 3/2014 | des Jardins | B05C 11/1002 222/167 |
| 9,962,486 | B2 * | 5/2018 | Rosinko | A61M 5/14216 |
| 10,556,207 | B2 * | 2/2020 | Ikushima | B05D 1/26 |
| 2003/0185096 | A1 * | 10/2003 | Hollstein | B01F 13/0845 366/273 |
| 2005/0072815 | A1 * | 4/2005 | Carew | F04B 7/0225 222/504 |
| 2005/0274739 | A1 * | 12/2005 | Raines | B05C 11/1042 222/146.2 |
| 2007/0298209 | A1 | 12/2007 | Kohlman et al. | |
| 2008/0105703 | A1 | 5/2008 | Prentice et al. | |
| 2012/0145743 | A1 * | 6/2012 | Ikushima | B05C 11/1007 222/1 |
| 2017/0209842 | A1 * | 7/2017 | Kim | B01F 7/021 |

FOREIGN PATENT DOCUMENTS

| | | | |
|---|---|---|---|
| CN | 102439310 | A | 5/2012 |
| CN | 103786964 | A | 5/2014 |
| KR | 10-2014-0056028 | A | 5/2014 |
| TW | 200510075 | A | 3/2005 |

OTHER PUBLICATIONS

GPD Global (2018) Level Detect User Guide, P/N 22200600, Version 1.3, Feb. 21, 2018 (11 pages).
GPD Global (2020) PCD Pump User Guide, Version 6.1, Feb. 26, 2020, Part No. 22293078M (67 pages).
GPD Global (2018) Syringe Agitator / Mixer, Uniform Dispensing for Mixed Fluids that Separate, Rev Apr. 2018 (1 page).
SR-TEK Syringe Mixer, Sep. 3, 2016 (1 page).
Chemtips, Air-Free Style, Dec. 11, 2012 (3 pages).
Specialist Castings Limited, Benefits of Centrifugal Casting, 2018, https://web.archive.org/web/20181127125030/http://www.specialistcastings.com/benefits-centrifugal-casting/ (3 pages).
Nordson EFD, Nordson EFD's New Automated Fluid Dispensing Systems Combine Precise Dispensing with Fast and Easy Programming, 2014, https://www.nordson.com/en/divisions/efd/about-us/news/nordson-efd-new-automated-fluid-dispensing-systems-10-6-14 (3 pages).
GPD Global, Brochure, Chinese, Rev Mar. 2011 (2011) (1 page).
Dow, Silicone Solutions for Powder Applications, 2018, Form No. 27-1564-01 B (4 pages).
Santomaso et al., Radial segregation driven by axial convection, Europhysics Letters, 75(4), pp. 576-582 (2006) https://arxiv.org/ftp/arxiv/papers/1606/1606.07696.pdf (8 pages).
Quinones et al. Silicone-Phosphor Encapsulation for High Power White LEDs, 2008, https://cdn.thomasnet.com/ccp/00240419/30622.pdf (4 pages).
Zhang et al., White LED with High Package Extraction Efficiency, Nov. 2008, Osram Sylvania (26 pages).
Musashi Engineering, Measuring Master, CAT No. MPP1-03157-E-COPY, 2016 (2 pages).
Riegler et al., NuSiL, Silicone Technology, Lightspan, Phosphors and Silicone Dispersions, 2005 (19 pages).
Wei et al., Mixing and characterization of nanosized powders: An assessment of different techniques, Journal of Nanoparticle Research 4: 21-41, 2002 (21 pages).
CN Appl. No. 202110670120.2, First Office Action, dated Aug. 1, 2022, English translation (Global Dossier) (7 pages).
CN Appl. No. 202110670120.2, First Office Action, dated Aug. 1, 2022 (7 pages).
CN Appl. No. 202110670120.2, Search, dated Jul. 25, 2022 (1 page).
TW Appl. No. 110119299, Search and Office Action, dated Aug. 15, 2022 (7 pages).
KR Appl. No. 2021-0078005, First Office Action, dated Feb. 24, 2023, English translation (Global Dossier) (5 pages).
KR Appl. No. 2021-0078005, First Office Action, dated Feb. 24, 2023 (Korean original) (4 pages).

* cited by examiner

Method 2000

Fill 2020

Dispense 2040

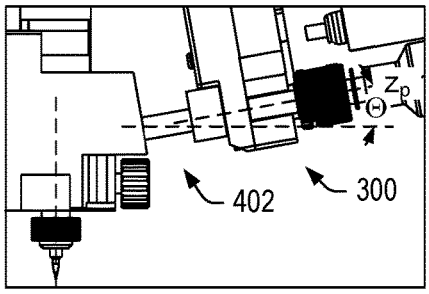
Fig. 9B
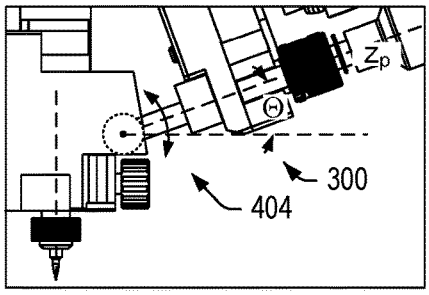
Fig. 9C
Fig. 9D
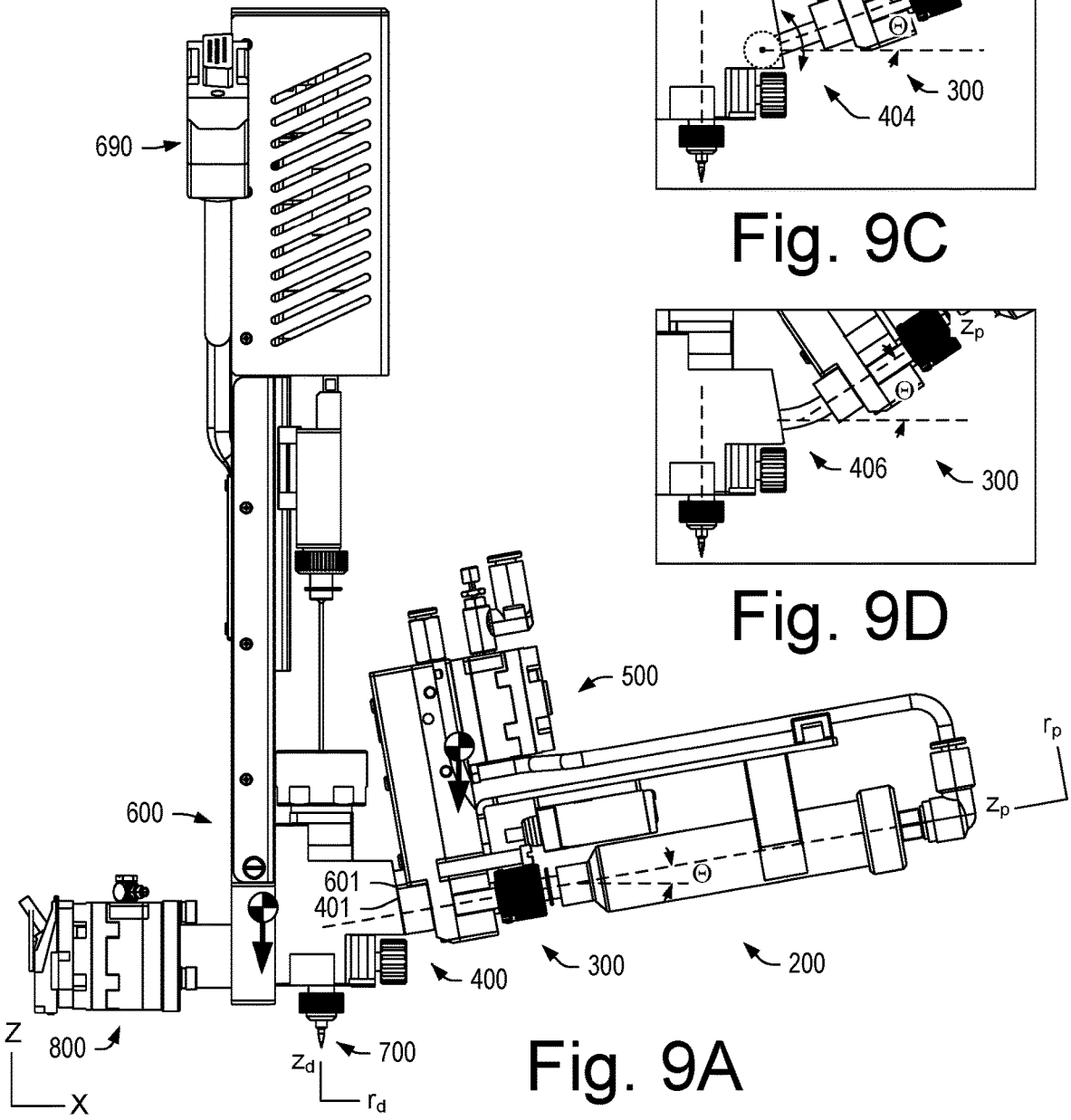
Fig. 9A

DISPENSING SYSTEM

TECHNICAL FIELD

Subject matter disclosed herein relates generally to dispensing systems for production of products.

BACKGROUND

A dispensing system can be utilized to dispense material in a controllable manner, for example, onto a substrate. In such an example, the material may be processed as part of a manufacturing process to make a product.

BRIEF DESCRIPTION OF THE DRAWINGS

A more complete understanding of the various methods, devices, assemblies, systems, arrangements, etc., described herein, and equivalents thereof, may be had by reference to the following detailed description when taken in conjunction with examples shown in the accompanying drawings where:

FIGS. 9A 9B, 9C and 9D are side views of the dispensing system of FIG. 8, an example of a dispensing system bridge, an example of a dispensing system rotatable bridge, and an example of a dispensing system flexible bridge, respectively;

DETAILED DESCRIPTION

Figure 1:
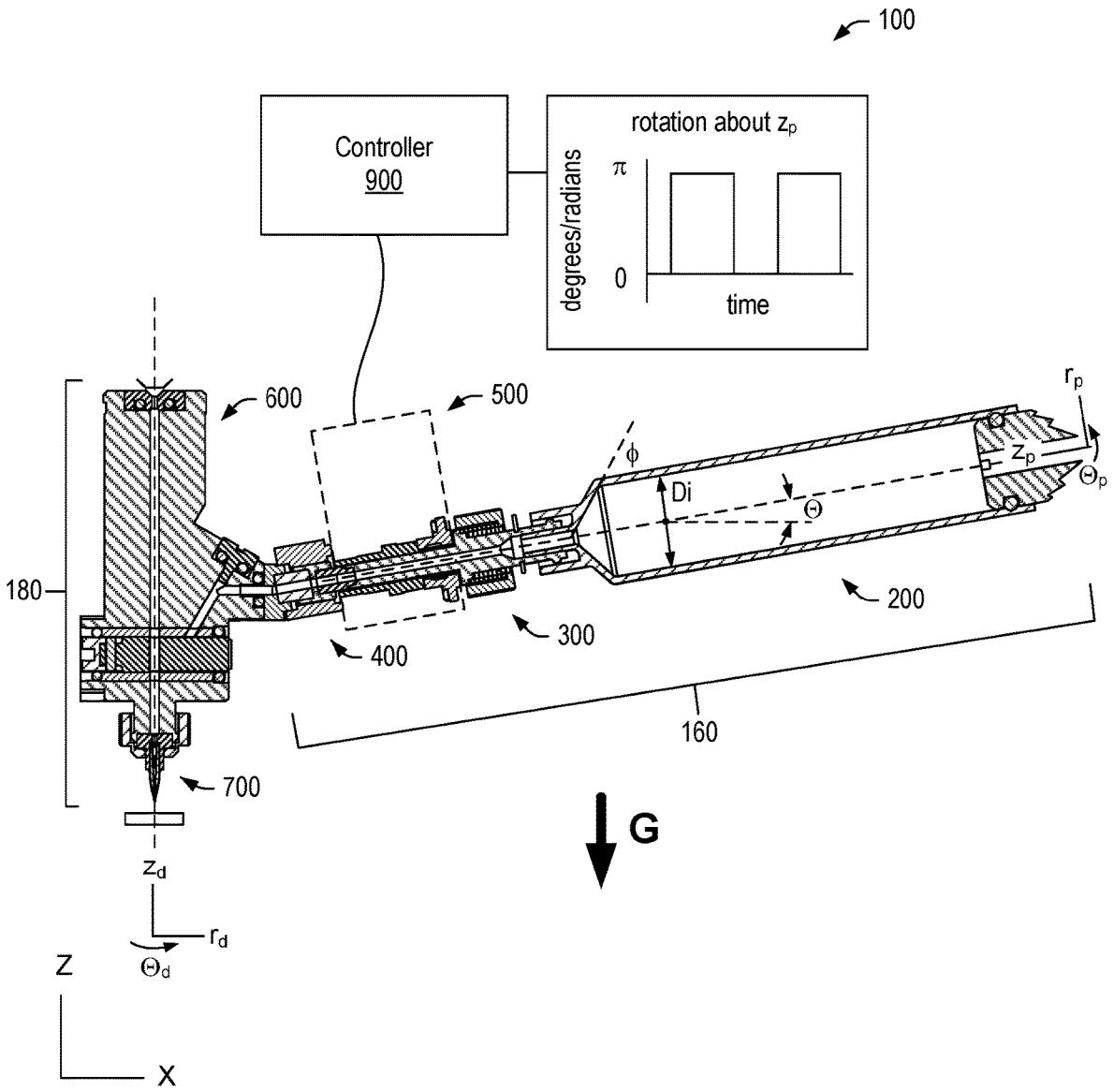
FIG. 1 is a diagram of an example of a dispensing system.

FIG. 1 shows an example of a dispensing system 100 that includes a material delivery assembly 160 and a nozzle body 180, which can include a control valve. As shown, various coordinate systems may be utilized to describe various features of the dispensing system 100. For example, a Cartesian coordinate system with coordinates X, Y and Z may be utilized where the cross-sectional view of FIG. 1 can be in an X, Z-plane. As shown, a cylindrical coordinate system with coordinates $z_d$, $r_d$ and $\Theta_d$ (axial, radial and azimuthal) may be utilized to describe various features of the nozzle body 180 and another cylindrical coordinate system with coordinates $z_p$, $r_p$ and $\Theta_p$ (axial, radial and azimuthal) may be utilized to describe various features of the material delivery assembly 160.

In the example of FIG. 1, the material delivery assembly 160 includes a longitudinal axis along the $z_p$ axis and the nozzle body 180 includes a longitudinal axis along the $z_d$ axis, which may be a material dispensing axis. As shown, the material delivery assembly 160 can be configured as a side arm to the nozzle body 180. A side arm angle may be defined using one or more coordinate systems. For example, consider an angle $\Theta$ as being a side arm angle defined using the $z_p$ axis and the X axis, which can be an axis that is orthogonal to the axis $z_d$ (e.g., a material dispensing axis). In the example arrange of FIG. 1, the angle $\Theta$ is approximately 10 degrees; noting that, in various examples, a side arm angle may be adjustable such that a side arm angle may be selected (e.g., manually, semi-automatically, automatically, etc.) within a range of side arm angles. As an example, a fixed or an adjustable side arm angle may be referenced with respect to a direction of the acceleration of gravity, which is shown by an arrow and a label, G, where the arrow is substantially aligned with the Z-axis and the $z_d$ axis in FIG. 1. As an example, a side arm angle may be adjustable between operations and/or during an operation (see, e.g., various examples of FIGS. 9A, 9B, 9C and 9D, etc.).

In operation, material loaded in the material delivery assembly 160 can flow to the nozzle body 180 for dispensing. As mentioned, a control valve can be included in the nozzle body 180 that can control flow of material into the nozzle body 180 and out of the nozzle body 180. For example, a control valve can include a fill mode orientation to receive material from the material delivery assembly 160 and a dispense mode orientation to dispense material from the nozzle body 180. In such an example, the material can be a single material or a mixture of different materials.

In the example of FIG. 1, the material delivery assembly 160 includes a tubular reservoir 200, a tubular extension 300, and a coupling assembly 400 that can fluidly couple the tubular extension 300 to the nozzle body 180. FIG. 1 also shows a motor assembly 500 as a block (dashed line) where a rotor coupling of the motor assembly 500 can operatively couple to the material delivery assembly 160 for rotation about its longitudinal axis $z_p$. For example, the motor assembly 500 can be actuated to provide for rotation of at least the tubular reservoir 200 about the longitudinal axis $z_p$. Where material in the tubular reservoir 200 is a mixture of materials and/or a mixture of different sizes and/or shapes of a material, rotation of the tubular reservoir 200 about the longitudinal axis $z_p$ can, for example, help to maintain a desirable distribution of materials, material, etc. As an example, where a distribution may be undesirable and/or trending toward undesirable, such rotation may be utilized to make the distribution more desirable. As mentioned, dispensed material may be utilized to manufacture a product. If one or more aspects of quality are not acceptable and/or trending toward unacceptability (e.g., via human inspection, machine inspection, etc.), one or more adjustments may be utilized to improve quality. For example, consider an adjustment to rotation, an adjustment to side arm angle, etc.

In the example of FIG. 1, the nozzle body 180 includes a control valve body 600 and a nozzle assembly 700. As shown, the nozzle assembly 700 is coupled to the control valve body 600. The control valve body 600 can be operatively coupled to or include an actuator for control of a control valve housed at least in part by the control valve body 600. For example, consider a stepper motor that can be utilized to rotate a switching rod to transition the switching rod between a fill mode orientation and a dispense mode orientation.

In the example of FIG. 1, a controller 900 is shown that can control one or more features of the dispensing system 100. For example, the controller 900 can control the motor assembly 500 such that the motor assembly 500 can rotate the material delivery assembly 160 about its longitudinal axis $z_p$. As shown, the controller 900 can operate according to control instructions, which can provide one or more control schemes for rotation of at least a portion of the material delivery assembly 160. As an example, a control scheme can provide for rotation in a clockwise (CW) direction, a counter-clockwise (CCW) direction or CW and CCW directions.

As an example, the controller 900 may provide for control of a side arm angle of the material delivery assembly 160 with respect to the nozzle body 180. In such an example, a motor or other type of actuator may be utilized to make adjustments to the side arm angle, which may affect material flow under the influence of gravity, affect flow of gas under the influence of gravity, affect mixing of material, etc.

As an example, the controller 900 can include one or more processors, memory and instructions executable by at least one of the processors. In such an example, upon execution of such instructions, the controller 900 can receive and/or issue one or more signals for purposes of controlling at least a portion of the dispensing system 100. As an example, the controller 900 can include one or more interfaces, which may include wired and/or wireless interfaces. As an example, the controller 900 may be operatively coupled to one or more quality control (e.g., quality assurance, etc.) systems, which may include machine vision equipment that can image a product or a portion thereof during manufacture, after manufacture, etc. The controller 900 may be a feedback controller in that one or more signals can be received by the controller 900 where the controller 900 can make one or more adjustments to the dispensing system 100 (e.g., physical, operational, etc.).

As explained, the dispensing system 100 can include the material delivery assembly 160, which can include a tubular reservoir 200 with the tubular extension 300, where the tubular reservoir 200 is aligned along the longitudinal axis $z_p$; the nozzle body 180, where the tubular extension 300 fluidly couples the tubular reservoir 200 to the nozzle body 180; and a rotor coupling of the motor assembly 500 that operatively couples to the material delivery assembly 160 for rotation of the tubular reservoir 200 about its longitudinal axis $z_p$.

FIG. 1 also shows various angles, including the angle $\Theta$ and an angle $\phi$ where, as mentioned, a direction of acceleration of gravity G is shown for reference. The angle $\Theta$ is shown with respect to horizontal, which can coincide with the X-axis; noting that it may be defined with respect to the longitudinal axis $z_d$ of the nozzle body 180. The angle $\phi$ is shown as being a cone angle of the tubular reservoir 200, which may be defined with respect to the longitudinal axis $z_p$.

In various instances, where gravity assist of flow is not required and/or where buoyancy as to gas elimination is not required, the tubular reservoir 200 may be substantially horizontal (e.g., plus or minus 3 degrees from horizontal). Where a material in the tubular reservoir 200 is amenable to sedimentation (e.g., segregation, etc.), a horizontal orientation may be beneficial as a sedimentation direction will be downward (e.g., aligned with gravity), which can be counteracted by rotation of the tubular reservoir 200. Where gas is present, a tilt angle (e.g., a side arm angle) may be selected such that given viscosity, forces as to gas entrainment, etc., gas may rise due to buoyance to reduce risk of dispensing gas, which can cause material dripping (e.g., rather than dispensing of a continuous material dose). As an example, a tilt angle may be selected based in part on usage rate, which may be a volumetric flow rate of material out of a tubular reservoir. Where material residence time in the tubular reservoir 200 is longer (e.g., lower flow rate), more time may be available for gas migration out of material (e.g., depending on viscosity, etc.), which may allow for use of a tilt angle that is closer to horizontal; whereas, where material residence time is shorter, a greater tilt angle may be beneficial.

Figure 2A:
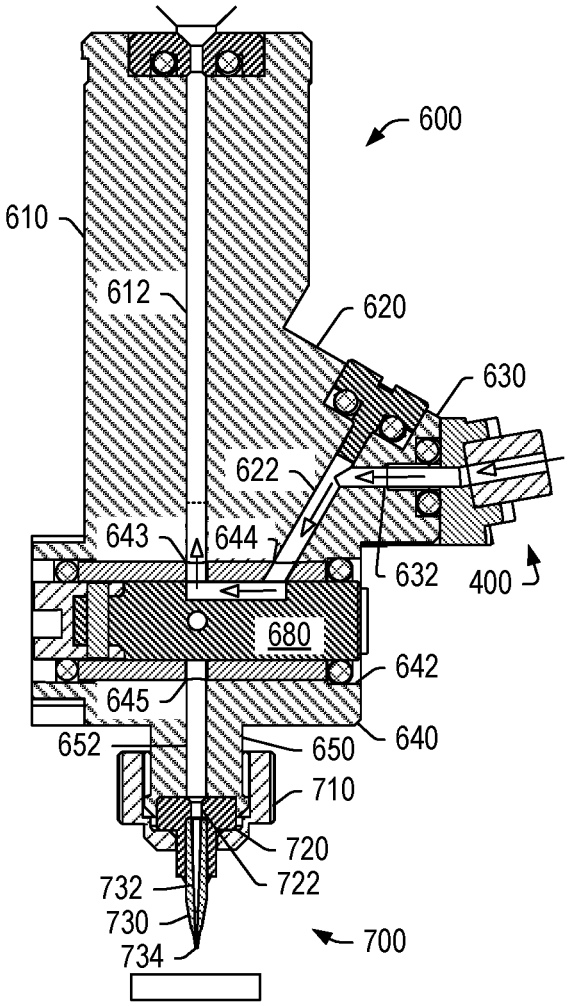
FIGS. 2A, 2B, 2C and 2D are diagrams of an example of a method of operating a dispensing system.
Figure 2B:
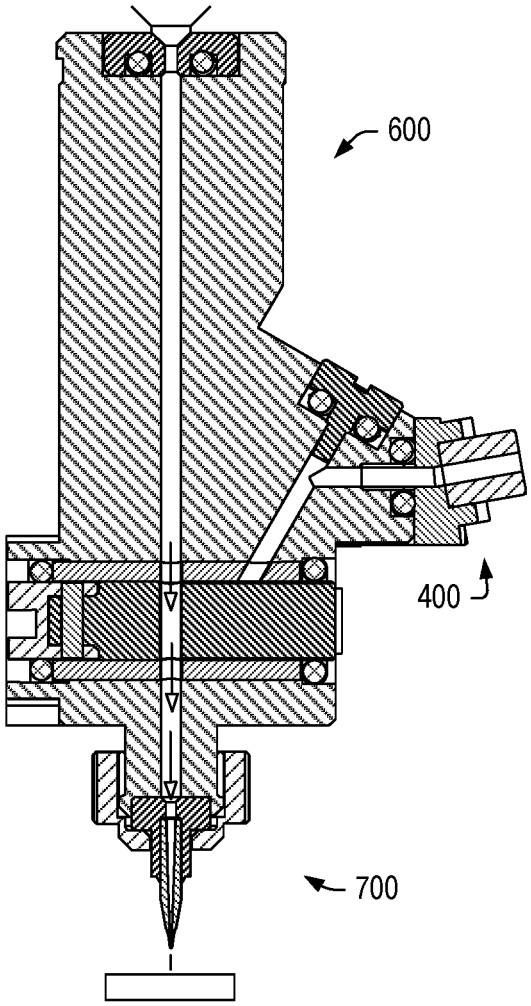
Figure 2C:
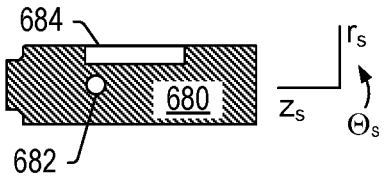
Figure 2D:
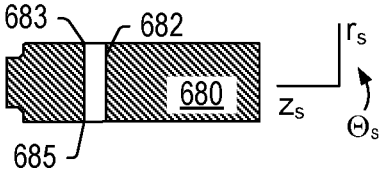

FIGS. 2A, 2B, 2C and 2D show an example of a method 2000 that includes a fill mode 2020 for filling a dose of material (see, e.g., FIGS. 2A and 2C) and a dispense mode 2040 for dispensing the dose of the material (see, e.g., FIGS. 2B and 2D).

As shown, the control valve body 600 includes an upright boss 610 with a through bore 612, an angled boss 620 with through bore 622, a side boss 630 with a through bore 632, a valve boss 640 with a through bore 642, and a nozzle boss 650 with a through bore 652. The bores 612, 622, 632, 642 and 652 can be referred to as passages where various passages can be in fluid communication, or not, via operation of a switching rod 680 disposed at least in part in the through bore 642 of the valve boss 640. For example, the bore 632 can be a material reception passage that receives material via a reservoir fit to the coupling assembly 400. As shown in FIG. 1, the material delivery assembly 160 can be operatively coupled to the control valve body 600 via the coupling assembly 400 such that the reservoir of the tubular reservoir 200 can be in fluid communication with the bore 632.

In the example of FIGS. 2A, 2B, 2C and 2D, the bore 642 is oriented orthogonally to the bore 612 and the bore 652. As shown, the bores 612 and 652 are aligned along a common axis (see, e.g., the $z_d$ axis of FIG. 1). The nozzle assembly 700 is coupled to the nozzle boss 650 via a fitting 710 that secures a nozzle base 720, having a selected nozzle 730, to the nozzle boss 650. As shown, the nozzle base 720 includes a through bore 722 and the nozzle 730 includes a through bore 732 where a common axis of the bores 722 and 732 is aligned with the axis of the bore 652. The nozzle 730 includes a nozzle opening 734, which is an opening of the bore 732. Shape, size, etc., of the nozzle 730, including its bore 732 and opening 734, may be selected according to use, material, etc. (e.g., process parameters).

The bore 642 includes various bore wall openings 643, 644 and 645. The bore wall opening 643 is an opening of the bore 612, the bore wall opening 644 is an opening of the bore 622 and the bore wall opening 645 is an opening of the bore 652.

The switching rod 680 includes a through bore 682 with openings 683 and 685 and a slot 684. In FIGS. 2A and 2C, the switching rod 680 is in a fill orientation and in FIGS. 2B and 2D, the switching rod 680 is in a dispense orientation, where the switching rod 680 may be defined using a cylindrical coordinate system with an axial coordinate $z_s$, a radial coordinate $r_s$ and an azimuthal angle $\Theta_s$. In the example of FIGS. 2A, 2B, 2C and 2D, the slot 684 is not in fluid communication with the bore 682; noting that one or more of various types of switching rod configurations may be utilized, one or more of which may include a bore or slot that is in fluid communication with a through bore such as the bore 682.

In the fill mode 2020 of FIGS. 2A and 2C, the switching rod 680 is oriented such that the slot 684 is in fluid communication with the openings 643 and 644 such that material can flow from the bore 622 to the slot 684 and from the slot 684 to the bore 612. Once the bore 612 is filled with a desired amount of material, a transition to the dispense mode 2040 of FIGS. 2B and 2D can occur, where the switching rod 680 is rotated by approximately 90 degrees about its longitudinal axis such that the through bore 682 is aligned with the bore 612. In such an orientation of the switching rod 680 in the bore 642, material in the bore 612 can flow through the bore 682 and to the bore 652. Where the nozzle assembly 700 is coupled as shown in FIGS. 2A and 2B, material can flow from the bore 652 to the nozzle 730 where dispensing can occur when material flows outward from the opening 734 of the nozzle 730. In such an example, the material, where fluid, may flow to deposit onto a component (e.g., a substrate, etc.) as a continuous uninterrupted fluid stream of a desired dose of material.

The method 2000 may be repeated numerous times, for example, to dispense material onto components where a fill and dispense cycle may be performed for each of the components.

To control the switching rod 680, as a valve rod, the switching rod 680 may be operatively coupled to a motor such as, for example, a stepper motor. In such an example, the stepper motor may be actuated responsive to a schedule, a signal, etc., to rotate the switching rod 680 to orient features thereof with respect to features of a bore of a control valve body. Such a motor may be operatively coupled to a controller that can control filling and dispensing, at least in part via orienting a switching rod.

As an example, the controller 900 of FIG. 1 may be configured for control of one or more features of the dispensing system 100, which may include an actuator that can control a control valve of the control valve body 600. For example, the controller 900 of FIG. 1 may be operatively coupled to an actuator that can control transitioning of the switching rod 680 between the fill orientation of FIGS. 2A and 2C and the dispense orientation of FIGS. 2B and 2D. Such an actuator may be, for example, an electronic actuator, an electromagnetic actuator, etc.

As an example, the dispensing system 100 may be suitable for dispensing of material in a powder form. As an example, the dispensing system 100 may be suitable for dispensing a liquid, which may or may not include material dispersed therein. As an example, the dispensing system 100 may be suitable for dispensing a mixture where the mixture can include particles dispersed in a fluid such as a liquid. As an example, the dispensing system 100 may be suitable for dispensing a gel, which may be a mixture that may include particles dispersed within the gel.

As an example, a gel can be a colloidal network, a polymer network or a colloidal and polymer network. A gel may have a finite yield stress, which may be relatively small. As an example, a gel may include a covalent polymer network, which may be a network formed by crosslinking polymer chains or by nonlinear polymerization. As an example, a gel may include a polymer network formed through physical aggregation of polymer chains, caused by hydrogen bonds, crystallization, helix formation, complexation, etc., that result in regions of local order acting as the network junction points. As an example, a gel may include a polymer network formed through glassy junction points (e.g., one based on block copolymers, etc.). As an example, a gel may include one or more types of lamellar structures. As an example, a gel may include particulate disordered structures.

As an example, a material may include silicone or polysiloxane as polymers made up of siloxane (e.g., polymerized siloxanes or polysiloxanes, etc.). As an example, a material may include one or more inorganic silicon-oxygen backbone chains that may include organic groups attached to each silicon center (e.g., consider methyl groups, etc.). As an example, a material may be cyclic or polymeric. As an example, a silicone material may be formulated to exhibit desirable properties (e.g., liquid, gel, etc.). As an example, a material can include a silicone fluid where one or more substances are dispersed in the silicone fluid.

As an example, a material can be a mixture that includes various components. For example, consider a formulated material that includes a powder and a carrier fluid and optionally one or more dispersing agents. A formulated material may be a formulated fluid material that can flow responsive to gravity, pressure or pressure and gravity. As an example, a formulated material may be of desired properties such as density, viscosity, etc. As an example, a formulated material may involve formulating to achieve density matching, which may help to reduce settling of particles in the formulated material. As an example, a formulated material may involve formulating to achieve a desired viscosity, which may help to reduce settling of particles in the formulated material. As an example, a formulated material may involve formulating to achieve desirable density matching and viscosity, which may help to reduce settling of particles in the formulated material.

In various examples, while material formulation may help to reduce detrimental particle phenomena, gravity, fluid dynamics, etc., may act in complex manners such that risks of detrimental particle phenomena exist in a dispensing system. Detrimental particle phenomena may include, for example, settling, aggregation, breakage, segregation, etc.

Referring again to FIG. 1, the tubular reservoir 200 is shown as being disposed at the angle $\Theta$ where the cone angle $\phi$ is also shown. As to various types of physical phenomena, as an example, the tubular reservoir 200 may be considered to be a hopper or a silo for material such as a powder in a fluid. In various types of hoppers and silos, material can be particles in air (e.g., air as a fluid) such that when oriented with a longitudinal axis (e.g., cone axis) aligned with gravity, one or more types of flow may occur where the type of flow can depend on various factors.

Figure 3A:
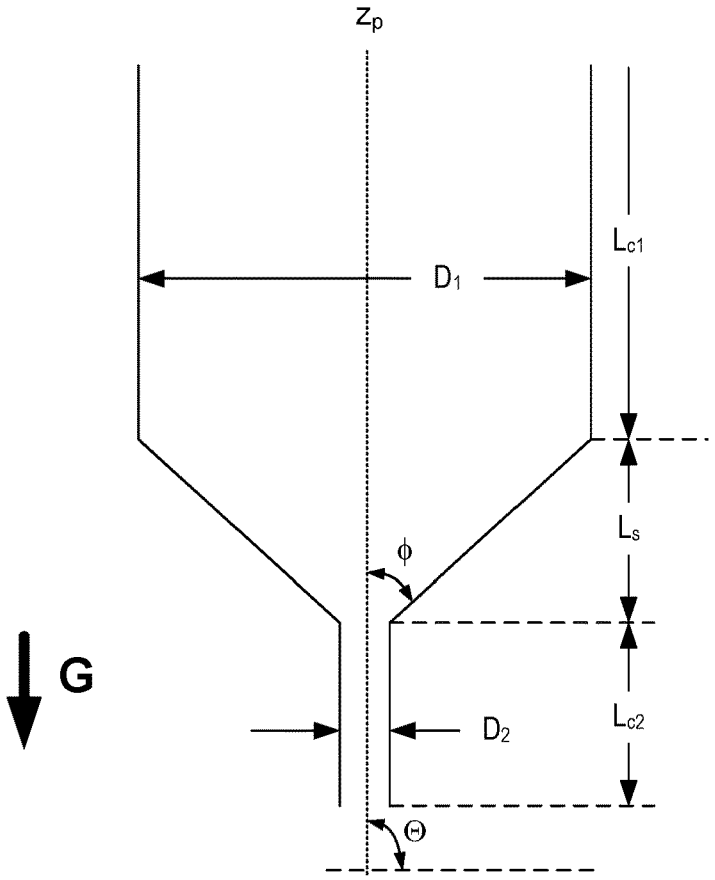
FIGS. 3A, 3B and 3C are diagrams of examples of types of flow.
Figure 3B:
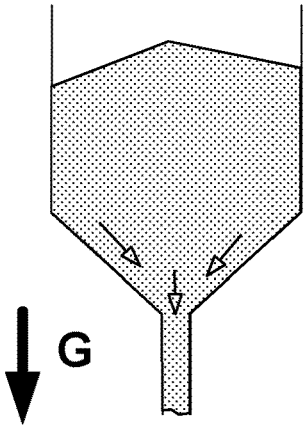
Figure 3C:
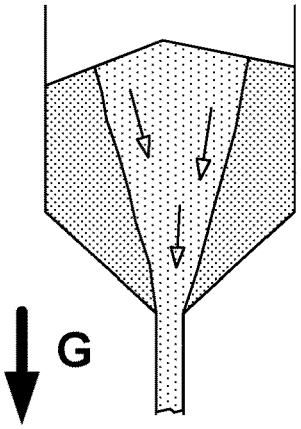

FIGS. 3A, 3B and 3C show a funnel (e.g., a reservoir) and two types of flow, which include mass flow in FIG. 3B and funnel flow in FIG. 3C. In FIG. 3A, an example funnel is shown with various dimensions, including axial dimensions $L_{c1}$ (cylinder height), $L_s$ (cone height), and $L_{c2}$ (spout height), diameters $D_1$ (cylinder diameter) and $D_2$ (spout diameter) and angles $\phi$ (cone angle) and $\Theta$ (tilt angle), where a central axis may be the axis $z_p$ as in the dispensing system 100 of FIG. 1.

Based on the material flow properties measured in a laboratory, a reservoir can be designed to function with mass flow or funnel flow. In mass flow, every particle is in motion during discharge; otherwise, flow is funnel flow. Mass flow presents various benefits. For example, mass flow can guarantee complete discharge of contents at flow rates that tend to be predictable. When successfully designed, a mass flow reservoir may provide for re-mixing of bulk solids during discharge, which may have segregated during the filling of the reservoir. In various instances, segregation may be largely addressed via mass flow; noting that careful filling procedures can be utilized as additional or alternative measures when segregation is undesirable.

Funnel flow tends to occur for reservoirs with squat hopper geometry or a flat bottom; noting that such geometries may store more material than a mass flow reservoir of the same overall height and diameter. Reduced headroom and therefore reduced capital expenditure can make a funnel flow reservoir an attractive solution in certain circumstances, for example, when segregation of particulate solids is not a pressing issue. A particular concern in designing a funnel flow reservoir can be avoidance of erratic flow (e.g., consider formation of a rat hole) and assurance of a complete cleanout of solids during discharge (e.g., little to no residual solids remaining, which can be economically beneficial and help to avoid carry-over from batch to batch, etc.).

As shown in FIG. 3A, the cone angle $\phi$ together with alignment with gravity (tilt angle $\Theta$=90 degrees) means that gravity can act on particles to force them against the cone wall (e.g., conical surface) while particles on and near the longitudinal axis $z_p$ have a rather unobstructed path toward the opening where gravity can promote flow along such a path.

Figure 4A:
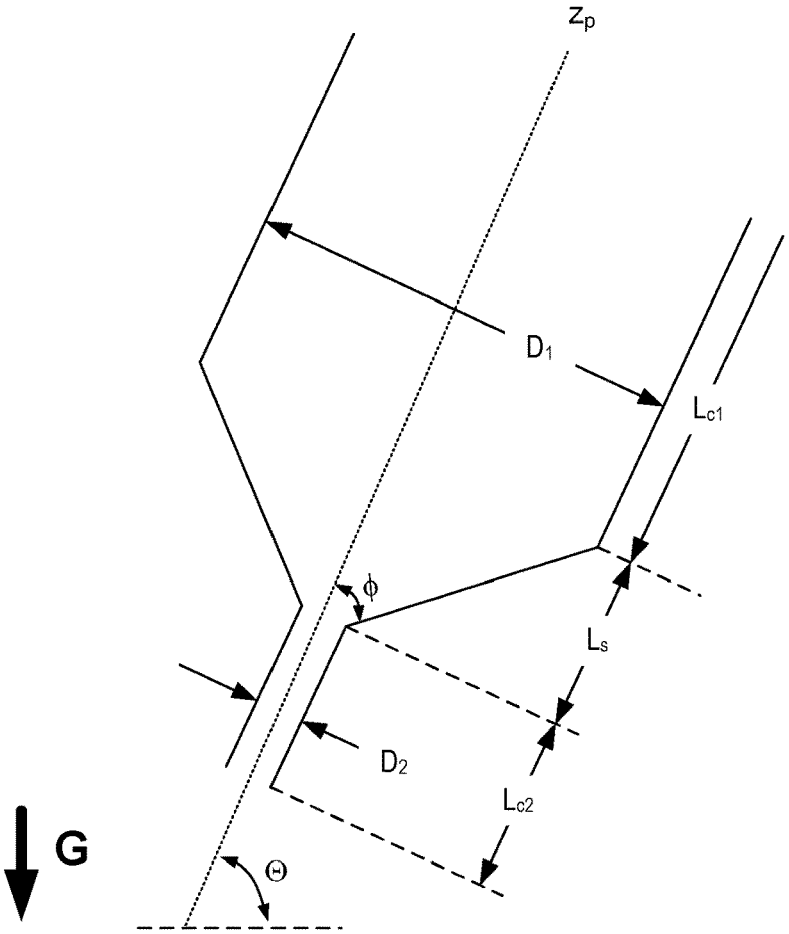
FIGS. 4A and 4B are diagrams of an example of a type of flow.
Figure 4B:
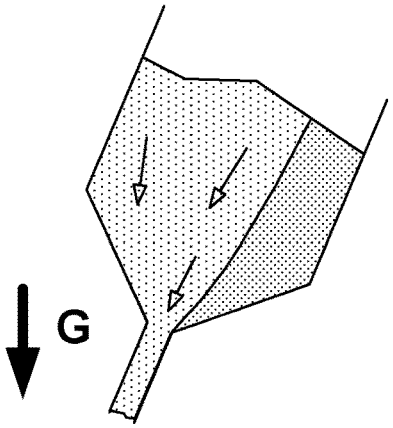

FIGS. 4A and 4B show an example of a funnel (e.g., a reservoir) that is tilted such that the longitudinal axis $z_p$ is not aligned with gravity. In the tilted orientation, a portion of the cone wall is at an even greater angle with respect to vertical while an opposing portion of the cone wall is at a lesser angle with respect to vertical. In such an orientation, funnel flow can exist that is asymmetric, as illustrated. In such an orientation, a dead zone (e.g., a stagnant zone) can form where material, which may be segregated due to its characteristics, does not flow out of the reservoir. A dead zone may demand particular operations to clear dead zone material; otherwise, such material may interfere with a subsequent batch. Such a clearing process may be a cleaning process where the dead zone material may be scrap (e.g., unusable for its intended purposes) or otherwise demand recycling (e.g., mixing into another batch or batches).

Various types of phenomena described with respect to the examples of FIGS. 3A, 3B and 3C and FIGS. 4A and 4B may apply to a material that can be a powder or a material that can include particles in a fluid such as, for example, a liquid, a gel, etc.

Figure 5:
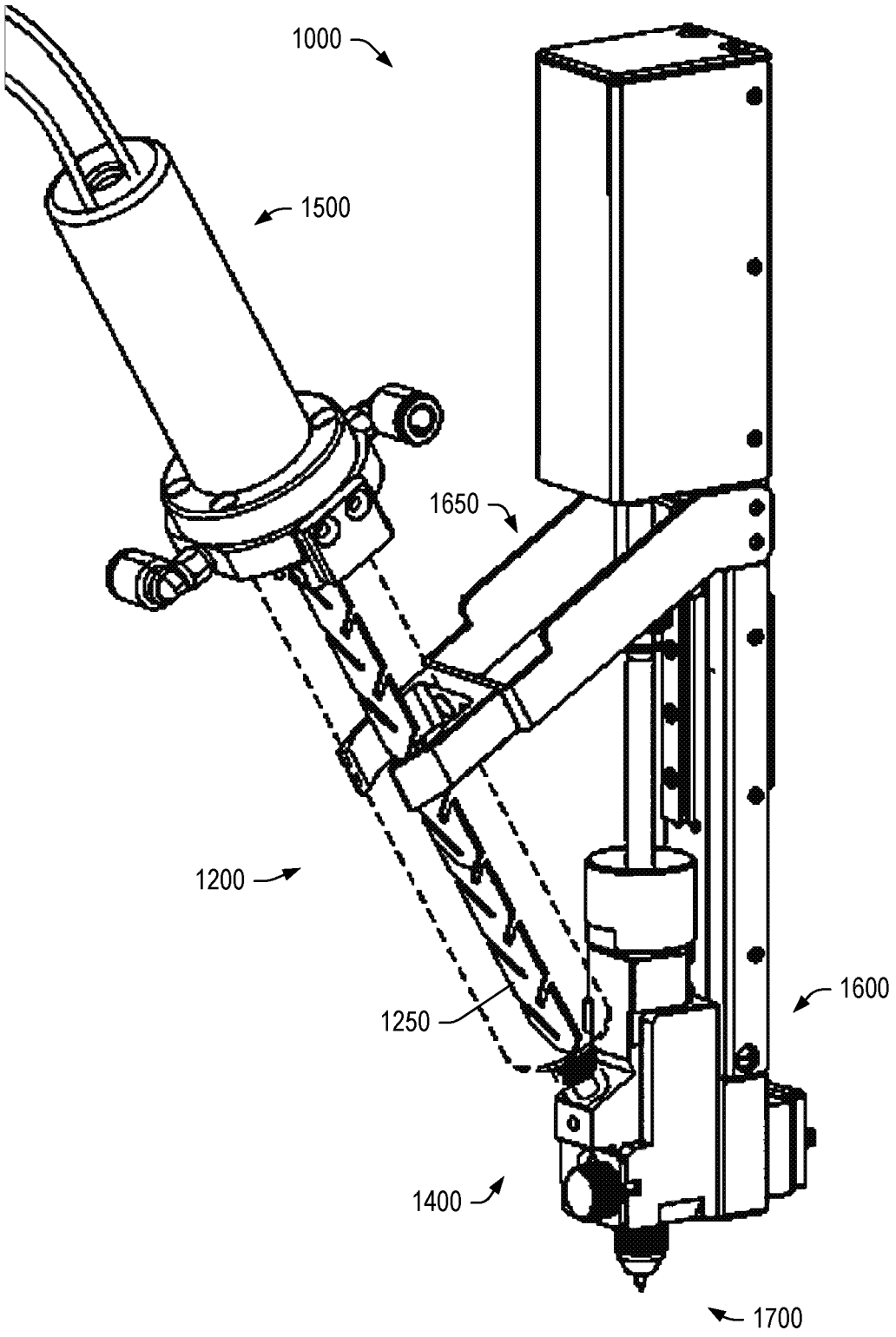
FIG. 5 is a diagram of an example of a dispensing system that relies on an internal paddle mixer that rotates in a stationary reservoir.

FIG. 5 shows an example of a dispensing system 1000 that includes a tubular reservoir 1200, a coupling assembly 1400, a motor 1500, a control valve body 1600 and a nozzle assembly 1700. As shown, the dispensing system 1000 includes a fixed bracket 1650 that secures the tubular reservoir 1200 at a fixed angle. As shown, the motor assembly 1500 is at a distance from the nozzle assembly 1700 (e.g., a distance of at least the longitudinal axis length of the tubular reservoir 1200) where the motor assembly 1500 may include relatively dense components that add mass such that the fixed bracket 1650 is also tasked with supporting the mass of the motor assembly 1500. For example, a motor can be motor that includes various types of relatively dense materials, which can be metallic materials, which can include permanent magnets, windings of electrical wire, etc. Such a motor can be fit with a paddle or other shaped mixing component that is inserted into a reservoir (e.g., to be an internal mixing component) such as a syringe where a rotor of the motor rotatably drives the mixing component. A rotor of the motor may be rated to rotate at speeds that may be in excess of 1000 rpm. For example, consider a SR-TEK syringe mixer (SR-TEK, Milton Keynes, UK) that is rated with a minimum speed of 20 rpm and a maximum speed of 5000 rpm for syringe capacities of 10 cc, 30 cc and 55 cc where input voltage is 24 VDC, torque 21 mNm and mass 0.4 kg (400 grams or approximately 0.9 lbs). Thus, the mass of a motor may be designed to be sufficiently large to handle rotational speeds of a mixing component that may be in excess of 1000 rpm where the motor can supply sufficient torque to an internal mixing component to overcome resistance between the internal mixing component and material in the tubular reservoir 1200, which may vary during dispensing (e.g., as level decreases, resistance may decrease). Further, the mass of a motor can exceed the mass of a reservoir payload. For example, given a 55 cc syringe and a material density of 1 gram per cc, the reservoir payload mass would be 55 grams, which is less than 15 percent of the mass of the motor (e.g., 0.4 kg).

As to some examples of standard size syringes, consider a 5 cc size with an axial length of approximately 7.2 cm (e.g., 2.83 inches), a 10 cc size with an axial length of approximately 9.1 cm (e.g., 3.58 inches), a 30 cc size with an axial length of approximately 11.9 cm (e.g., 4.67 inches) and a 55 cc size with an axial length of approximately 17.6 cm (e.g., 6.91 inches). Thus, as volume of a syringe increases, the axial length of the syringe generally increases, which places motor mass at a greater distance from a material outlet of the syringe. In terms of torque, the axial length of a syringe may be a lever arm where torque due to the mass of a motor can be estimated using the equation $T=mgL*\sin(\alpha)$, where m is the mass, g is the acceleration of gravity, L is the lever arm length, and a is an angle from vertical (e.g., direction of the acceleration of gravity). As such, where the angle $\alpha$ approaches horizontal, torque increases to a maximum. Torque may place structural demands on one or more fittings, coupling, etc., and may demand that a particular process is followed for maintenance, re-fill, etc., to assure that motor mass related gravity torque does not cause a failure of one or more components. Further, as the axial length of a syringe increases, the length of a paddle or other shaped mixing component generally increases (e.g., to reach deeper into the syringe). An increased length can place increased rotational torque demands on the motor (e.g., as more material contact occurs with an internal mixing component, etc.). Yet further, a dispensing system with a mixer may demand various mixing components with various axial lengths. In other words, changes may need to be made in a manner that depends on volume of a reservoir. And, as axial length of a mixing component increases, dynamics of behavior of the mixing component may become more pronounced. For example, consider bending modes, resonance modes, etc., which may occur at particular rotational speeds. Various modes may be detrimental and result in material damage, undesirable flows, etc. As shown in FIG. 5, the fixed bracket 1650 may be required to be of a sufficiently robust design to handle motor mass, lever arm length, and desirable and undesirable behavior of a mixing component that is inserted into a material reservoir and rotated by the motor to mix the material.

As shown in FIG. 5, the motor assembly 1500 can rotate an internal paddle mixer 1250 that is inside the tubular reservoir 1200. Through rotation of the internal paddle mixer 1250 in the static tubular reservoir 1200, the type of funnel flow as shown in FIGS. 4A and 4B may be at least in part mitigated. For example, a paddle width can be sized with respect to a reservoir diameter and axial length such that mechanical interactions between the internal paddle mixer 1250 and material can disturb at least a portion of a region that may otherwise be a dead zone region. However, with a greater outer diameter, the rotational torque demands may increase for the motor and, for example, a greater risk of an internal paddle mixer getting stuck.

In the example of FIG. 5, materials of construction of the tubular reservoir 1200 and the internal paddle mixer 1250 must be considered with respect to fill material in the tubular reservoir 1200. Further, shape, edge profiles, etc., of the internal paddle mixer 1250 may impact performance, material characteristics, distribution of particles in a powder, etc. For example, fragile particles may be subjected to undesirable shearing, which may cause such particles to break and thereby alter particle size. In such an example, additional variables are introduced that may ultimately impact a fill mode, a dispense mode, processing of dispensed material, etc. In other words, an internal paddle mixer approach can complicate one or more processes for making a product.

Additionally, an internal paddle mixer is another component that can demand servicing, cleaning, space for insertion or removal, etc. Use of an internal paddle mixer can add to non-productive time (e.g., downtime) as it can make a re-filling workflow more complicated and hence time consuming. Yet further, material may be present in the tubular reservoir 1200 prior to insertion of the internal paddle mixer 1250. Where such insertion is performed by a human, there may be variations between humans as to how the internal paddle mixer 1250 is inserted, cleaned, etc. For example, one human may insert the internal paddle mixer 1250 rapidly with a considerable amount of force, which may break, aggregate, etc., particles; whereas, another human may insert the internal paddle mixer 1250 slowly and gently, which may help preserve material integrity but increase downtime. Where an effort is made to operate quickly to re-fill, an internal paddle mixer can, for various reasons, be problematic. In various instances, an internal paddle mixer can be sharp (e.g., knife-like), which may present a danger to humans and equipment. Further, where material is on the internal paddle mixer, such material may fall off the internal paddle mixer when removed, which may demand special cleaning procedures (e.g., as to a floor, a table, a workstation, etc.). If the material is hazardous, then procedures may be further complicated.

As explained, the dispensing system 100 can include the material delivery assembly 160, which can include a tubular reservoir 200 with the tubular extension 300, wherein the tubular reservoir 200 is aligned along the longitudinal axis $z_p$; the nozzle body 180, where the tubular extension 300 fluidly couples the tubular reservoir 200 to the nozzle body 180; and a rotor coupling of the motor assembly 500 that operatively couples to the material delivery assembly 160 for rotation of the tubular reservoir 200 about its longitudinal axis $z_p$.

The dispensing system 100 can operate without an internal paddle mixer as a rotational mechanism can be utilized to agitate a container of material; whereas, the internal paddle mixer approach demands direct contact with material in a container.

In various instances, a non-direct contact rotational mechanism to agitated dispensed material can be material saving as, for example, no direct contact means that no material may stick on an operational part such as an internal paddle mixer such that a greater percentage of material can be utilized for dispensing (e.g., consider increased utilization, which may reduce number of fill events, etc.). Further, a rotational approach to a container can help to reduce sedimentation, which may prolong material life and reduce waste of material due to sedimentation.

As an example, in various instances, a non-direct contact rotational mechanism approach can save time at least in part through a reduction in down time when compared to an internal paddle mixer approach. As an example, when material is used up, re-filling can be via replacement of a reservoir (e.g., a syringe) without demand for stopping a production run, waiting for internal paddle mixer cleaning, etc.

As to maintenance, as an example, a rotational mechanism can rotate a material bridge (e.g., a tubular extension) along with a reservoir (e.g., a syringe) where cleaning can be readily performed. For example, a material bridge can be designed for easy assembly and disassembly, where only certain parts demand dismantling for cleaning.

As explained with respect to the dispensing system 1000 of FIG. 5, the internal paddle mixer 1250 approach makes the agitator system design problematic when it comes time for material changing. For example, when empty, an operator needs to completely stop the dispensing system 1000 for material changing such that the operator can dismantle the agitator and separate out the internal paddle mixer for a relatively lengthy process of cleaning before the operator can provide new material for dispensing. Without cleaning, material may stick on the internal paddle mixer that can carry forward to a new batch of material, which can cause particle characteristics to be different from batch to batch.

As explained, an internal paddle mixer can depend on various parameters, which can be critical to proper operation. For example, a mistake in design or damage to an internal paddle mixer due to cleaning, travelling, etc., can cause agitated material to have uneven particle distribution in each dispensed dose (e.g., dot, line, etc.). Such unevenness can cause an increase in reject rate, for example, due to inconsistent performance of a product (e.g., consider CIE 127-1997 test standard for LED products, etc.).

In the internal paddle mixer approach, the internal paddle mixer tends to be a reusable component that can have a long duration of contact with material. In such an approach, friction between the internal paddle mixer and material can generate heat and electrostatics that can cause part of the material to be impacted, for example, to cure, to stick on the internal paddle mixer, etc., which might affect the material particle content as agitation time pass. In general, a longer agitation time can cause more material damage through interactions, which can cause material particle concentration to decrease as time pass due undesirable phenomena such as, for example, curing and sticking.

While an internal paddle mixer may aim to reduce dead zone formation and persistence, an agitation approach that uses an internal paddle mixer may cause material to stick on a barrel side wall, which, for a transparent wall, can cause visibility problems (e.g., hard to verified current material level). Further, as mentioned, there can be an uneven particle concentration where sticking, dead zoning, etc., occurs. As to wall sticking, consider material being forced toward a barrel wall, which can cause collision and friction and generate electrostatics that can cause material to stick on the barrel wall.

In various instances, an internal paddle mixer approach can result in condensation of material as agitated material temperature can be higher than outer temperature.

In various instances, an internal paddle mixer approach can cause gas entrainment (e.g., bubble formation, etc.). For example, as an internal paddle mixer is rotated in material, it can generate turbulence or a wave inside the material itself that might cause the material to overlap and cause microbubble entrainment. A dripping issue is known to exist for instances where gas entrainment occurs.

As explained, a rotational approach that rotates a reservoir can avoid direct contact with material via a mixing component like an internal paddle mixer. As explained, a rotational mechanism can drive a material bridge (e.g., tubular extension) that connects to a syringe (e.g., a reservoir) such that issues of material sticking on a wall and a mixing element (e.g., an internal paddle mixer) while at the same time improve material changing.

Figure 6:
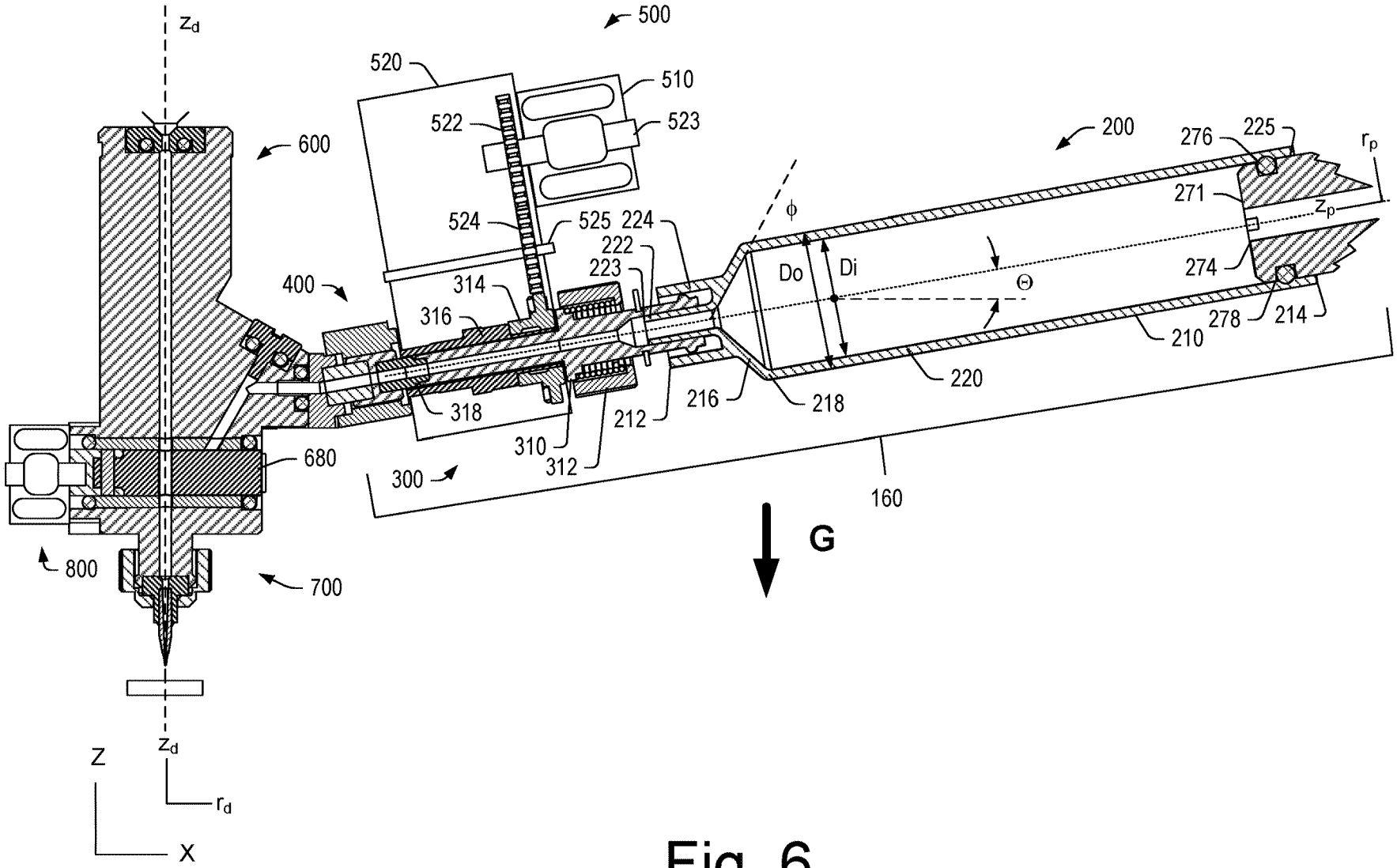
FIG. 6 is a diagram of an example of a dispensing system that includes features of the dispensing system of FIG. 1.

FIG. 6 shows the dispensing system 100 as in FIG. 1 where the material dispensing assembly 160 includes a syringe 210 as a tubular reservoir that extends from a proximal end 212 to a distal end 214 where, between the proximal end 212 and the distal end 214, a conical wall 216 meets a tubular wall 220 at a transition region 218. The syringe 210 is centered along the longitudinal axis $z_p$ about which various features may be described. For example, the tubular wall 220 includes an inner diameter Di and an outer diameter Do that can be measured using the axis $z_p$ where a difference in diameters can be utilized to define a wall thickness. The syringe 210 can also be characterized using various axial lengths that can be measured with respect to the axis $z_p$.

At the proximal end 212, the syringe 210 includes cylindrical walls 222 and 224 where the cylindrical wall 222 is an inner cylindrical wall and the cylindrical wall 224 is an outer cylindrical wall. As shown, the walls 222 and 224 are concentric and define an annular receptacle that can receive a component. For example, the syringe 210 can include a Luer type of receptacle for coupling the syringe 210 to a tube 310 of the tubular extension 300. In such an example, the tube 310 can include a lumen (e.g., a channel, etc.) that can be in fluid communication with a reservoir space defined by the syringe 210. For example, the inner cylindrical wall 222, the conical wall 216 and the tubular wall 220 can define a reservoir space, which can be a reservoir volume. In the example shown, most of the reservoir space is defined by the tubular wall 220.

As shown, the syringe 210 includes a proximal opening 223 at the proximal end 212 and a distal opening 225 at the distal end 214. While either of the openings 223 and 225 may be utilized for introducing material into the syringe 210, the opening 223 is utilized for flow of material from the syringe 210 to the tube 310 of the tubular extension 300, which extends from the syringe 210 as coupled thereto via the Luer type connection.

In the example of FIG. 6, a plug 271 (e.g., a stationary plug or a plunger) is received at least in part via the distal opening 225 at the distal end 214 of the syringe 210. As shown, the plug 271 can include a passage 274 (e.g., a bore, etc.) and can include a seal element 276 seated in a groove 278, for example, consider an O-ring as a seal element seated in an annular groove such that a seal is formed between the O-ring and the inner surface of the syringe 210. In such an example, gas may pass out of the reservoir space (e.g., degassing a material, etc.) via the passage 274, the reservoir space may be pressurized using gas introduced via the passage 274, etc. As an example, the plug 271 may include one or more features of a syringe plunger that may be translatable along the $z_p$ axis. As to re-filling the reservoir space, the plug 271 can be removable and replaceable.

As shown, the tubular extension 300 can include various components that can include a spring-loaded compression fitting 312, one or more annular components 314 and 316, and a coupling 318. As explained the motor assembly 500 can include a rotor coupling that can engage one or more components of the tubular extension 300. For example, consider a rotor coupling that can engage the annular component 314, the annular component 316 or the annular components 314 and 316. As an example, various component may be attached, coupled, interference fit, compression fit, etc., for purposes of rotation via the rotor coupling. As mentioned, the rotor coupling can directly and/or indirectly provide for rotation of a reservoir. For example, where the tube 310 is rotated via rotation of the rotor coupling, a reservoir coupled to the tube 310 can rotate via rotation of the rotor coupling (e.g., as engaged by a motor, etc.).

As an example, the annular component 314 can include gear teeth and the motor assembly 500 can include a motor 510 operatively coupled to a transmission 520 where the transmission includes one or more gears 522 and 524 with corresponding sets of gear teeth that can rotate about respective axles 523 and 525 where, for example, one of the sets of gear teeth of the one or more gears 522 and 524 can engage the gear teeth of the annular component 314. Where the annular component 314 is securely fit to the annular component 316 (e.g., a sleeve) and where the annular component 316 is securely fit to the tube 310, engagement of the annular component 314 by one or more features of the motor assembly 500 can cause the tube 310 to rotate. As the tube 310 can be securely fit to the syringe 210, the syringe 210 can rotate in unison with the tube 310.

Thus, as explained, the motor assembly 500 can be utilized to rotate the syringe 210. While the example of FIG. 6 shows the motor assembly 500 engaging the tubular extension 300, as an example, a motor assembly may engage one or more features of the syringe 210, which may be via direct engagement rather than via the tubular extension 300. In the example of FIG. 5, while gears are described, one or more other approaches, additionally or alternatively, may be utilized. For example, consider a drive belt operatively coupled directly or indirectly to the tubular extension 300 and/or the syringe 210, one or more rubberized wheels operatively coupled directly or indirectly to the tubular extension 300 and/or the syringe 210, etc.

As explained with respect to FIGS. 4A and 4B, a cone may be disposed at an angle (e.g., a tilted cone) where a dead zone may develop as to material flowing out of the cone via an opening. As explained with respect to FIG. 5, the internal paddle mixer 1250 may aim to mitigate a tendency to develop a dead zone; however, such an approach can complicate operation of a dispensing system. As explained with respect to the dispensing system 100, a motor assembly can be utilized to rotate a reservoir that includes a tilted cone. For example, a syringe can be a reservoir with a cone defined along a cone axis where the cone axis may be tilted at an angle that makes the cone a tilted cone. A tilted cone can be defined as a cone where its cone axis is not aligned with gravity (e.g., vertical orientation). As an example, a tilted cone can be at an angle that is greater than horizontal such that material can flow in a direction due in part to acceleration of gravity. As an example, a tilted cone can be tilted at an angle that is greater than 0 degrees (horizontal) and less than 90 degrees (vertical and aligned with gravity). As an example, a tilted cone may be horizontal where, for example, a pressure can be applied to cause material to flow.

As to various features of a syringe, a syringe can include a plunger, a plunger seal, and a plunger flange where the plunger flange may bear a load of a plunger pusher (e.g., consider a thumb of a medicinal syringe with a needle). As an example, a syringe can include a barrel flange, which can be located on a barrel of the syringe (e.g., a tubular body of the syringe).

As mentioned, a syringe can include Luer type of features. For example, consider a Luer lock as a screw fitting for attaching a component to a syringe such that the component will not detach when a barrel of the syringe is pressurized. As an example, a syringe can include a Luer taper where, for example, a Luer-slip fitting may conform to dimensions of a Luer taper such that friction is used to secure the fitting rather than matching threads.

FIG. 6 also shows an approximate representation of an example of a motor assembly 800 that can engage the switching rod 680 to orient the switching rod 680 in a fill mode orientation and to orient the switching rod 680 in a dispense mode. As explained, a controller such as the controller 900 of FIG. 1 may be utilized to control one or more portions of a dispensing system.

As an example, a motor of the motor assembly 500 and/or a motor of the motor assembly 800 may be a stepper motor or another type of motor. As an example, a stepper motor may be a permanent magnet stepper motor (e.g., permanent magnet rotor, etc.), a variable reluctance stepper motor, or a hybrid stepper motor (e.g., features of a permanent magnet stepper motor and a variable reluctance stepper motor). As an example, the motor assembly 500 and the motor assembly 800 may include common motor types. Referring again to the dispensing system 1000 of FIG. 5, the motor assembly 1500 can be a type of motor that differs from a switching rod actuation motor. As mentioned, a motor of the motor assembly 1500 may be rated for rotational speeds in excess of 1000 rpm where a relatively long and narrow mixing component is inserted into a syringe and rotated. In such an approach, multiple different types of control equipment may be required, one for the motor assembly 1500 and another for a switching rod actuation motor. In contrast, as an example, where the motor assembly 500 and the motor assembly 800 include a common type of motor, which may be configured for making relatively precise, less than full 360 degree rotations, configuration of a controller may be simplified. As mentioned with respect to FIG. 1 and FIGS. 2A, 2B, 2C and 2D, a controller may control an actuator to rotate a switching rod by approximately 90 degrees to change orientations (e.g., or approximately 270 degrees to return to a particular orientation after a 90 degree orientation, etc.) and may control another actuator to rotate a reservoir by an increment that is less than or equal to 360 degrees (e.g., a single rotation or less).

As an example, a motor of a motor assembly may be configured for rotation in a clockwise (CW) direction and/or in a counter-clockwise (CCW) direction. As an example, a controller may operate a motor of a motor assembly according to a schedule such as, for example, from an initial position of 0 degrees, rotate a syringe 180 degrees ($\pi$) in a first direction and then rotate the syringe back to 0 degrees in the first direction or in an opposite direction, where such a schedule can be repeated. In such an example, wait times, rotation speed, interval between cycles, etc., may be control parameters that may be adjustable and/or adjusted responsive to feedback (e.g., sensor input, etc.).

Figure 7:
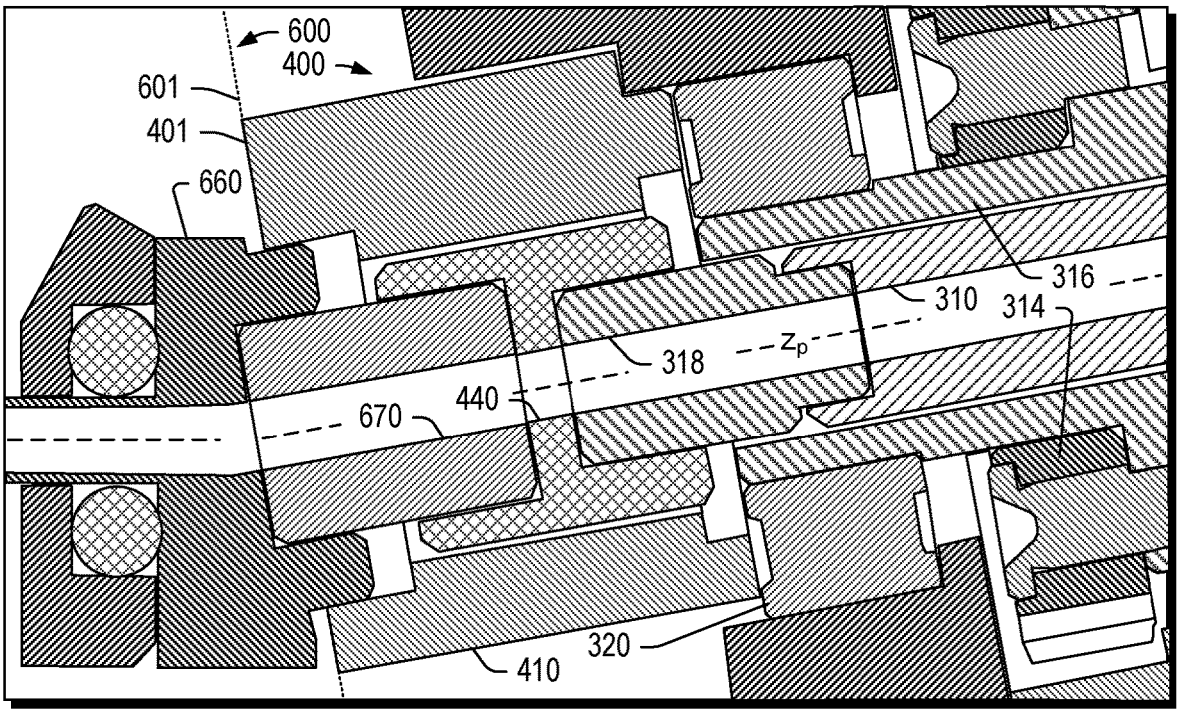
FIG. 7 is a diagram of an example of various components of an example of a dispensing system.

FIG. 7 shows a cross-sectional view of an example of a sub-assembly that includes features of the tubular extension 300, the coupling assembly 400 and the control valve body 600. As shown in the example of FIG. 7, the coupling assembly 400 can include a seating surface 401 and the control valve body 600 can include a seating surface 601 (represented by a dotted line) where the seating surfaces 401 and 601 can be in contact.

In FIG. 7, various components can rotate while other components remain stationary. As to rotating components, consider the tube 310, the annular components 314 and 316 and the coupling 318. As an example, the tube 310 and the coupling 318 can be fixed to each other, for example, via brazing (e.g., where the tube 310 and the coupling 318 are made of suitable metallic materials). As shown, a bushing or bearing 320 can be utilized to guide rotation of the rotatable components of the tubular extension 300. Such an approach may aim to maintain coaxial alignment of features of the tubular extension 300 and features of the coupling assembly 400.

As shown in the example of FIG. 7, the coupling assembly 400 includes various components such as a coupling body 410 and a seal 440 and the control valve body 600 includes a fitting 660 and a coupling 670. In the example of FIG. 7, the coupling 670 can be fixed to the fitting 660, for example, via brazing (e.g., where the coupling 670 and the fitting 660 are made of suitable metallic materials). As shown, the seal 440 is seated within the coupling body 410, which may be via an interference fit (e.g., with ample dimensions to account for expansion and/or contraction with respect to changes in temperature, etc.). As an example, the seal 440 may be formed from a polymeric material, a composite material, etc. In the example of FIG. 7, material that flows from the tube 310 may contact the seal 440. In such an example, the seal 440 can be made of a material that is compatible with the flowing material such that interactions (e.g., physio-chemical, etc.) do not substantially impact processing, etc.

As an example, the seal 440 can be stationary in the coupling body 410 where rotation of the coupling 318 occurs within a bore of the seal 440. As shown, the seal 440 can include a though bore with opposing counter bores where one of the counter bores can be of a diameter that is greater than the other one of the counter bores. In the example of FIG. 7, the axial depth of the counter bores is approximately the same where the counter bore with the greater diameter can have a surface area that is greater than the surface area of the other counter bore. In such an example, the force resulting from rotation of the coupling 318 may be less than the frictional force between the coupling 670 in its respective counter bore of the seal 440. Such an approach can help to maintain the seal 440 stationary when the coupling 318 rotates.

In the example of FIG. 7, the fitting 660 includes a through bore with a bend that can cause a flow path to change from a first angle to a second angle. In such an example, the first angle may be a tilt angle of a conical portion of a syringe and the second angle may be substantially horizontal.

As shown in the examples of FIG. 1 and FIG. 7, a distance between a reservoir and a control valve (e.g., the switching rod 680) can be relatively short such that material retained in a dispensing system when a reservoir is removed tends to be minimal (e.g., compared to a volume of the reservoir).

As an example, the size of the tube 310 can be relatively small to help reduce sedimentation. For example, the tube 310 can have a relatively small diameter and a relatively short length such that it has limited volumetric space for sedimentation, while also being subjected to rotation for purposes of agitation that can reduce sedimentation.

As an example, a syringe may be pressurized using gas pressure (e.g., air, nitrogen, etc.) where such gas pressure can be a driving force (e.g., in combination with gravity due to a tilt angle) that provides for movement of material from the syringe to a control valve body, a nozzle assembly, etc.

Figure 8:
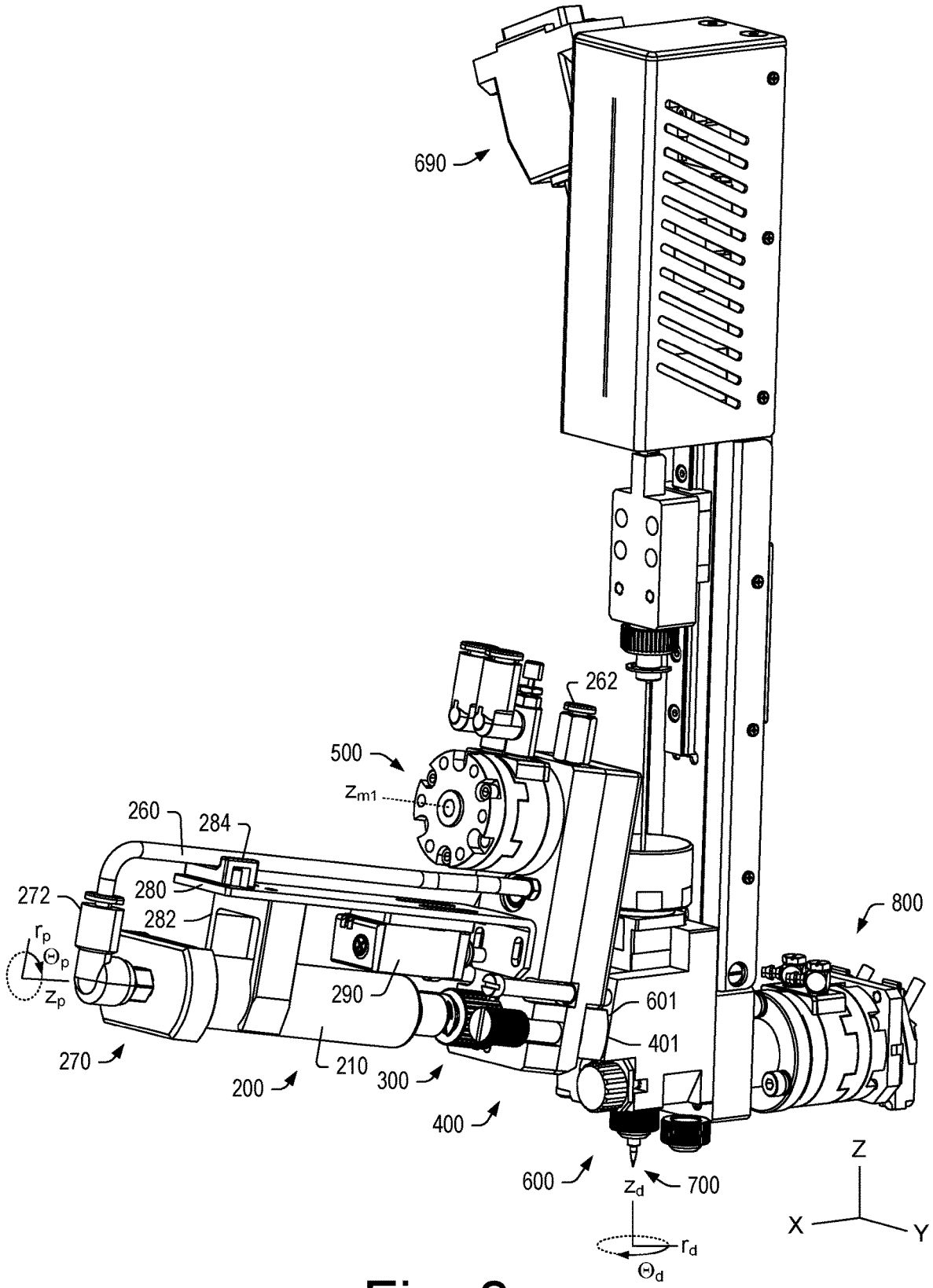
FIG. 8 is a perspective view of an example of a dispensing system.

FIG. 8 shows a perspective view of the dispensing system 100 of FIG. 1 as including an example of the motor assembly 500 and an example of the motor assembly 800. In the example of FIG. 8, the motor assembly 500 is actuatable to rotate a rotor via a stator to cause a rotor coupling to engage the material delivery assembly 160 to rotate the tubular reservoir 200. In the example of FIG. 8, the motor assembly 800 is actuatable to rotate a rotor via a stator to cause a switching rod to orient in a fill mode and to orient in a dispense mode, for example, as explained with respect to FIG. 2.

As shown in FIG. 8, the dispensing system 100 can include a connector or connectors 690, which may provide for one or more of data, signals and power. For example, consider sensor data transmission, control signal transmission and power transmission via one or more connectors.

FIG. 8 also shows a conduit 260 that can be operatively coupled to the syringe 210 via a coupling assembly 270 that allows for rotation of the syringe 210 without rotation of the conduit 260. As an example, the plug 271 may be a part of the coupling assembly 270 or otherwise, for example, operatively coupled thereto. As mentioned, the syringe 210 can be pressurized using a gas, which may be supplied via the conduit 260. The conduit 260 can be secured via one or more features of the motor assembly 500, which is shown as including a fitting 262 that may be utilized to secure a source of gas (e.g., pressurized gas). As an example, where a plug is translatable, upon translation in a direction toward a dispensing end of a syringe, gas may be expelled via a conduit such as, for example, the conduit 260.

FIG. 8 also shows an extension 280 that can be secured to the motor assembly 500 and/or the coupling assembly 400 where the extension 280 includes one or more support features 282 that can guide rotation of the syringe 210 in clockwise or counter-clockwise directions as rotated via the motor assembly 500, which is shown along with a motor axis $z_{m1}$. In the example of FIG. 8, the one or more support features 282 may provide for relatively low friction such that the syringe 210 can be rotated without damage to its exterior (e.g., wear, grooving, etc.). As an example, the one or more support features 282 may include one or more curved surfaces that can guide a circular outer surface of the syringe 210. As shown, the extension 280 can also include a mount or a guide 284 for the conduit 260.

As shown in FIG. 8, various bolts may be utilized to align and/or secure the material delivery assembly 160 with respect to the nozzle body 180. In the example of FIG. 8, various bolts include tool slots and/or knurls where knurls may facilitate tightening and/or loosening by hand. As an example, the material delivery assembly 160 can include one or more seating surfaces that contact and bear against one or more seating surfaces of the nozzle body 180. In the example of FIG. 8, the control valve body 600 includes the seating surface 601 (see, e.g., FIG. 7), which is disposed at an angle, and the coupling assembly 400 includes the seating surface 401 (see, e.g., FIG. 7), where the axis $z_p$ is substantially normal to the seating surface 401. As shown, due to the angle of the seating surface 601, a fraction of the mass of the material delivery assembly 160 can bear against the seating surface 601 via contact with the seating surface 401; whereas, if both surfaces were vertical there would be no force vector (e.g., considering statics and gravity). As shown, the motor assembly 500 is relatively close to and above the contacting seating surfaces 401 and 601 such that a force thereof due to gravity may bear down on the seating surfaces 401 and 601 (e.g., to provide for some weight bearing, etc.). As shown in the example of FIG. 7, the fitting 660 can include a boss that is received by a bore of the coupling body 410 where the fitting 660 provides for transitioning an angle of a passage (e.g., a flow path).

As shown in FIG. 8, various components can be supported by the motor assembly 500 where the motor assembly 500 can be located proximate to the control valve body 600. In such an example, a center of mass of the dispensing system 100 may be closer to the control valve body 600; whereas, in the internal paddle mixer 1250 approach of FIG. 5, the motor assembly 1500 is located a distance from the control valve body 1600 where that distance is at least approximately a length of the tubular reservoir 1200. In the approach of FIG. 5, the center of gravity (e.g., center of mass) is shifted due to the mass of the motor assembly 1500 being located a distance away from the control valve body 1600. Such an approach can make handling of the dispensing system 1000 awkward as components with substantial mass are not centralized. Such a system may be more subject to dropping, unintended movements, etc. As explained, where the tubular reservoir 1200 is in need of re-filling, a user must remove the motor assembly 1500 from the tubular reservoir 1200, including the internal paddle mixer 1250.

In the example of FIG. 8, re-filling of the syringe 210 can be accomplished by removal of the coupling assembly 270. For example, a snap fitting 272 may be released to decouple the conduit 260 from the coupling assembly 270 where the coupling assembly 270 can be readily decoupled from the syringe 210 to expose the opening 225 at the distal end 214 of the syringe 210. Referring again to FIG. 6, a portion of the coupling assembly 270 is shown with a seal ring and a bore that can be in fluid communication with the conduit 260 via the snap fitting 272.

As an example, the conduit 260 may be a flexible conduit such as a polymeric material conduit with sufficient slack such that decoupling via a snap fitting, etc., is not required when re-filling the syringe 210. For example, a re-filling method can include merely removing the coupling assembly 270 for the end of the syringe 210.

As an example, a re-filling method can involve decoupling the syringe 210 from the tubular extension 300. As mentioned a Luer type of connection may be utilized, which can be a threaded connection or a friction connection.

As an example, re-filling may be performed in a tool-less manner such that a user's hands can be used directly to remove the coupling assembly 270 for re-filling the syringe 210 with material and then replacing the coupling assembly 270 for further dispensing operation. Such a tool-less manner of re-filling can save time, reduce tool count, etc.

As shown in FIG. 8, the motor assembly 500 and the motor assembly 800 may include common motor types, which may optionally be interchangeable, which may facilitate replacement, spare parts demands, control, etc. Utilization of a common type of motor can result in cost reduction for manufacture as an order for the common type of motor may be of a higher number that is double that of a dispensing system that uses two different types of motors, for example, as in the dispensing system 1000 of FIG. 5. Further, a common motor type may provide for simplified controller as one or more instances of common control circuitry, a control program, a control application may be utilized, which can facilitate maintenance, updates, etc.

In the example of FIG. 8, a level sensor 290 can be included that can be positioned proximate to the syringe 210. As an example, the level sensor 290 can issue one or more signals to a controller that can indicate a level or levels of material in the syringe 210. As an example, the syringe 210 can include a wall made of a material of construction that is suitable for use with the level sensor 290. For example, the wall may be made of a transparent material of construction that is transparent to electromagnetic (EM) radiation in at least a portion of the visible spectrum. Such a sensor can include one or more emitters and one or more detectors. For example, consider an emitter that can emit EM radiation where reflection of such EM radiation can be sensed by one or more detectors. In such an example, where a material level changes from one state to another, the reflected EM radiation may change in a manner that can be sensed by the one or more detectors. For example, an empty syringe may result in a different EM reflection signal than a full syringe.

FIG. 9A shows a side view of the dispensing system 100 while FIG. 9B shows a bridge 402, FIG. 9C shows a bridge 404, and FIG. 9D shows a bridge 406. In the example of FIG. 9A, an approximate center of mass is illustrated for the material delivery assembly 160 and another approximate center of mass is illustrated for the other components, which include the nozzle body 180. As shown, the center of mass of the material delivery assembly 160 is relatively close to the seating surfaces 401 and 601. As mentioned, a motor may include various components that are relatively dense such as, for example, permanent magnets, winding wires, etc. Where such a motor is utilized to rotate a reservoir at a location between an end of the reservoir and a control valve body, the motor may be positioned more closely to the control valve body, which, in turn, may provide for a more mechanically balanced dispensing system (e.g., as opposed to a motor that rotates an internal paddle mixer where the internal paddle mixer is accessed via a distal end of the reservoir). As shown in the example of FIG. 9A, the motor assembly 500 is positioned axially closer to the proximal end 212 than the distal end 214 where the motor assembly 500 overlaps axially with the tube 310 (see, e.g., FIG. 6).

In the examples of FIGS. 9B, 9C and 9D, one or more brackets may be present that can stabilize the material delivery assembly 160. For example, consider an adjustable bracket that may include one or more telescoping features, one or more hinges, etc., such that it may be adjustable as to angle. Such an adjustable bracket may include a support that allows for rotation of a syringe. For example, consider a bushing or a guide that allows for relatively low friction rotation of a syringe within the bushing or the guide. As an example, an adjustable bracket may be operatively coupled to a component such as the extension 280, as shown in FIG. 8. As an example, one or more telescoping features may be controllable such that an angle may be selected (e.g., per one or more adjustments to the telescoping features). As an example, consider a toothed linear member that meshes with a rotatable toothed gear such that the linear member can be extended or retracted to adjust an angle thereof while an end thereof may be hinged about a pivot axis. As mentioned, FIG. 5 shows the fixed bracket 1650 that has at least four bolts (two for each arm) that support the mass of the motor 1500, which is positioned a substantial distance from the nozzle assembly 1700 (e.g., shifting the center of mass outwardly away from the nozzle assembly 1700).

In the example of FIG. 9B, the bridge 402 may be a rotating bridge or a stationary bridge. As an example, the bridge 402 may be transparent or translucent such that movement of material therein may be detectable via human vision or machine vision. As mentioned, a flow path may be relatively short to reduce residence time, amount of material in a flow path, etc. As an example, the bridge 402 may be less than approximately 20 cm and may be less than 5 cm. As an example, one or more sensors may be positioned proximate to the bridge 402, for example, to detect material therein or the absence of material therein. As an example, one or more sensors may be utilized to detect material, movements of material, presence of gas, etc.

In the example of FIG. 9C, the bridge 404 includes a joint that provides for rotation about an axis such that the angle Θ may be selectably adjusted. As an example, an actuator may be operatively coupled to the material dispensing assembly 160 such that the angle Θ can be selectably adjusted. As an example, a controller may be operatively coupled to such an actuator (e.g., a motor, etc.) such that the angle can be adjusted via the controller. In such an example, one or more adjustments may occur during operation, which may be prior to loading, during loading, after loading, during filling, after filling, during dispensing, after dispensing, etc. As an example, a controller may operate according to a schedule. As an example, a controller may operate responsive to sensor input where, for example, detection of undesirable gas or other material behavior may cause the controller to adjust an angle (e.g., consider increasing the angle Θ to cause gas to flow upwardly, etc.).

In the example of FIG. 9D, the bridge 406 may be flexible such that it is bendable within a bend limit. For example, various types of conduits have limits as to bend radius where a bend beyond the bend radius may risk deformation of a conduit. In the example of FIG. 9D, as mentioned, an adjustable bracket may be utilized to support a material delivery assembly. In the examples of FIGS. 9B, 9C and 9D, as mentioned, the bridges 402, 404 and 406 may be transparent or translucent for purposes of human vision or machine vision of material therein. As an example, one or more of the bridges 402, 404 and 406 may be rotatable; noting that rotation of the bridge 406 may result in flexing of the bridge 406.

Figure 10:
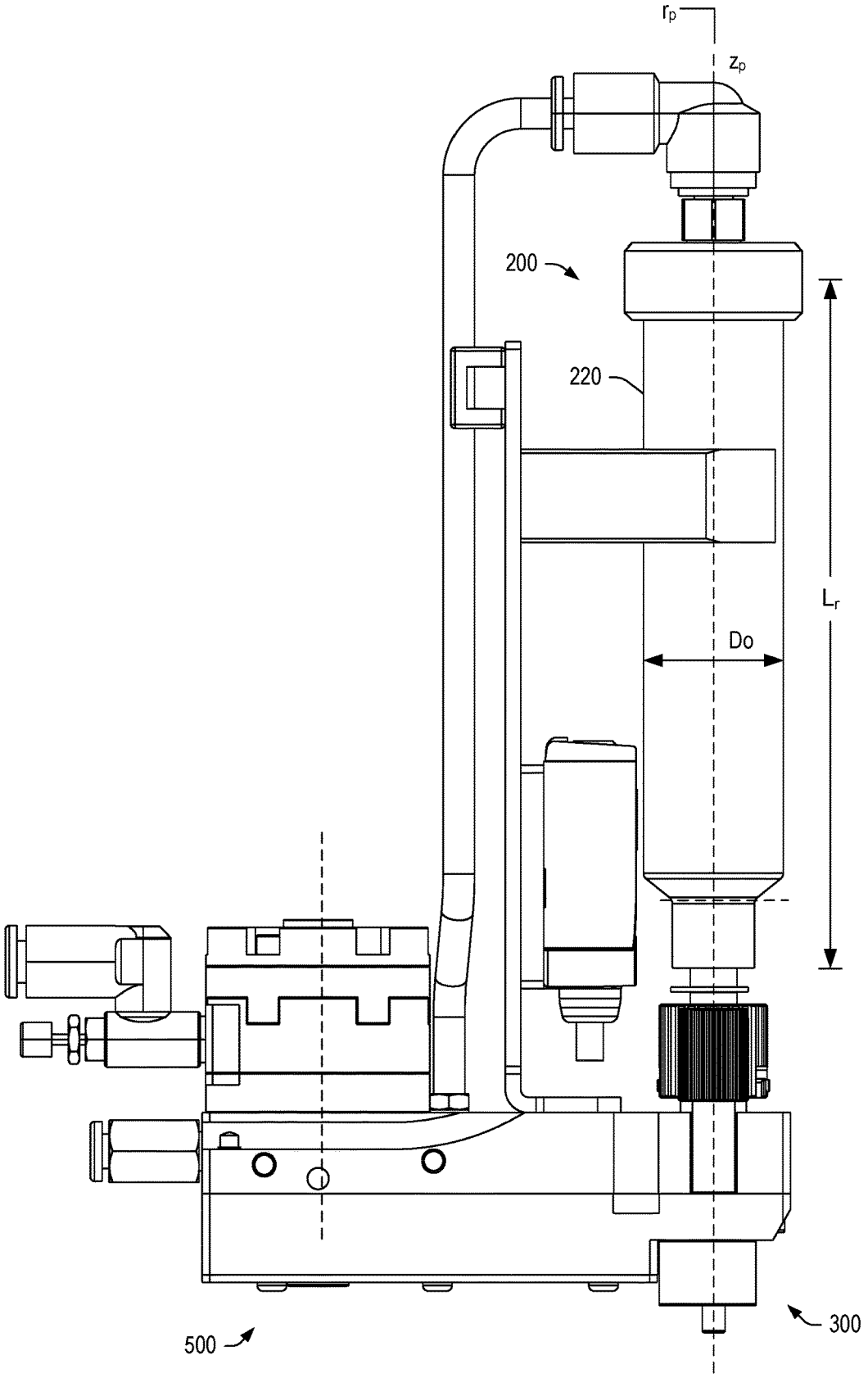
FIG. 10 is a side view of a portion of the dispensing system of FIG. 8.

FIG. 10 shows a side view of a portion of the dispensing system 100. In FIG. 10, a length or height dimension $L_r$ is shown for the syringe 210. As mentioned, the syringe 210 may be defined with respect to one or more diameters such as the outer diameter Do and the inner diameter Di.

Figure 11:
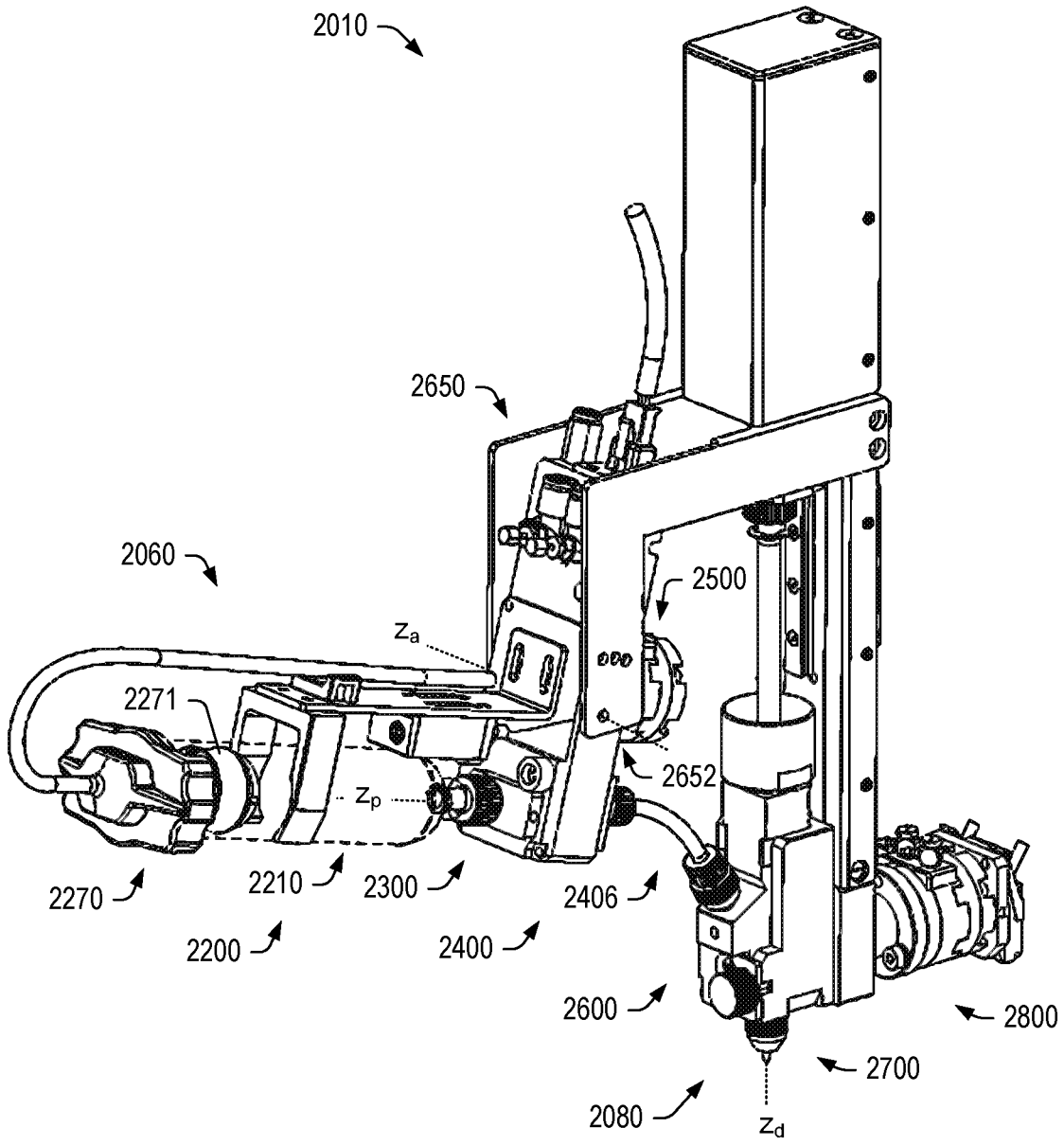
FIG. 11 is a perspective view of an example of a dispensing system.

FIG. 11 shows an example of a dispensing system 2010 that includes a material delivery assembly 2060 and a nozzle body 2080. As shown, the material delivery assembly 2060 can include a tubular reservoir 2200, a tubular extension 2300, and a coupling assembly 2400 that can fluidly couple the tubular extension 2300 to the nozzle body 2080. FIG. 11 also shows a motor assembly 2500 where a rotor coupling of the motor assembly 2500 can operatively couple to the material delivery assembly 2060 for rotation about its longitudinal axis (e.g., rotation of a reservoir about its longitudinal axis).

In the example of FIG. 11, the nozzle body 2080 includes a control valve body 2600 and a nozzle assembly 2700. As shown, the nozzle assembly 2700 is coupled to the control valve body 2600. The control valve body 2600 can be operatively coupled to or include an actuator 2800 for control of a control valve housed at least in part by the control valve body 2600. For example, consider a stepper motor that can be utilized to rotate a switching rod to transition the switching rod between a fill mode orientation and a dispense mode orientation.

In the example of FIG. 11, a material bridge 2406 is included such as, for example, the bridge 406 of FIG. 9D. As shown, a bracket 2650 can be adjustable using various features 2652 (e.g., sockets, friction components, etc.) such that the angle of the material delivery assembly 2060 can be adjusted with respect to the nozzle body 2080. For example, one or more axles may be aligned along an axis $z_a$ that is a pivot axis about which an angle of the material delivery assembly 2060 can be adjustable.

In the example of FIG. 11, a tubular reservoir 2210 is indicated by a dashed line, indicating that its size may be selected from a variety of sizes. As shown, a coupling assembly 2270 includes a plug 2271, which may be a plunger or piston that can be inserted into the tubular reservoir 2210. As an example, the position of the plug 2271 may be adjustable axially in the tubular reservoir 2210, for example, to match a volume of material in the tubular reservoir 2210. As an example, the position may be adjustable via pressure (e.g., to move inwardly, to move outwardly, etc.). As an example, a plug may be a solid plug or may be a plug with a passage or passages. As an example, a plug may move as material exits a tubular reservoir (e.g., to reduce a head space, etc.).

As an example, a syringe such as the syringe 210 may be of a volume in a range from approximately 1 cubic centimeter to approximately 1000 cubic centimeters. In various examples, the syringe 210 may be of a volume of approximately 10 cubic centimeters (e.g., a 10 cc barrel). As mentioned, syringe sizes may be standardized sizes that may include, for example, 3 cc, 5 cc, 10 cc, 30 cc and 55 cc. As an example, a range of sizes may be from less than 1 cc to approximately 250 cc. As an example, a syringe with a volume of 200 cc may be utilized where density of material to be carried within the syringe may be less than approximately 2 grams per cc. As an example, a dose to be dispensed may be characterized using a particle number such as, for example, a number of particles per dose (e.g., a number of phosphor particles per dose of a mixture of phosphor and silicone fluid, etc.). In such an example, a dispensing system such as the dispensing system 100 can help to assure that a relationship remains relatively constant for material dose and particle number, for example, via controlled rotation of a syringe as a reservoir for the material.

Figure 12:
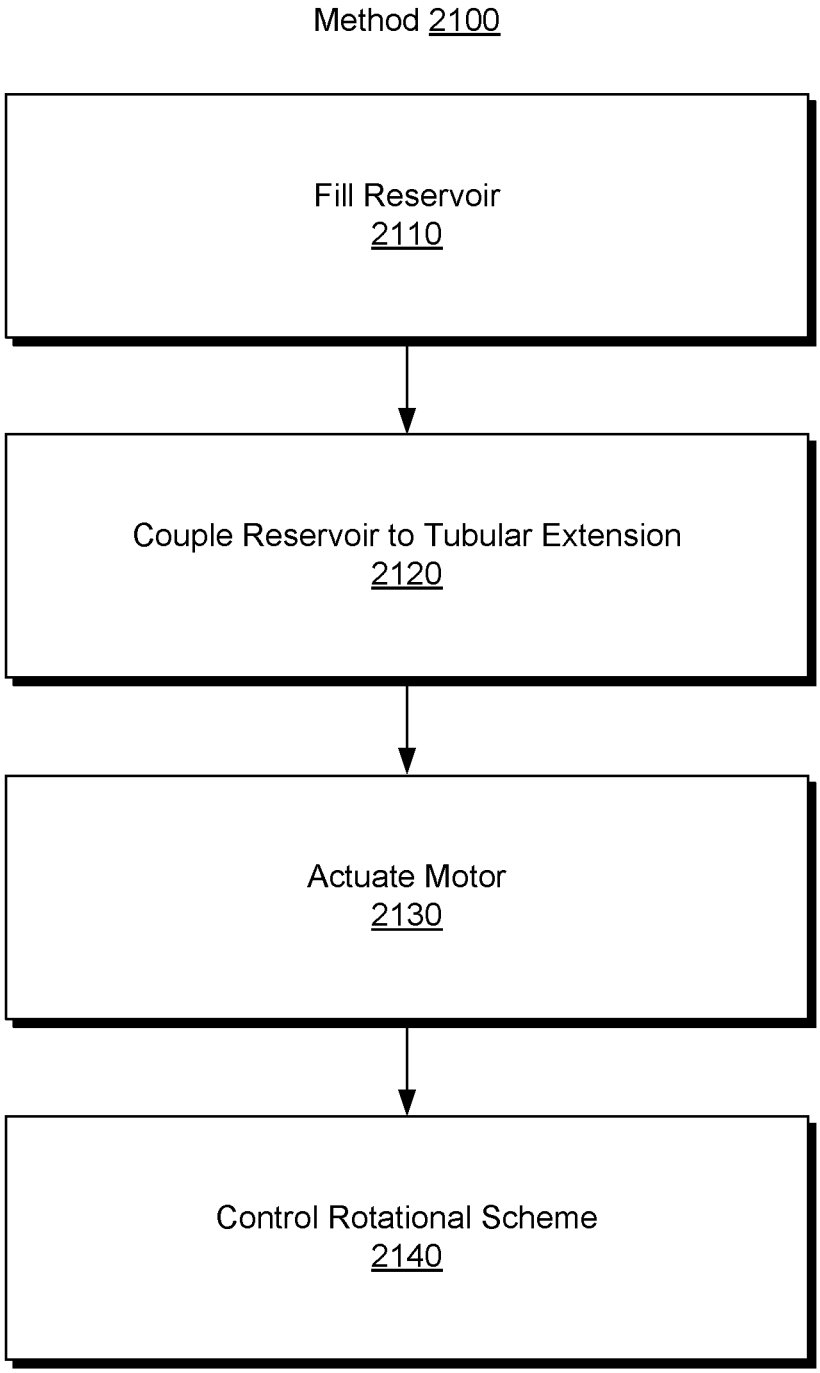
FIG. 12 is a diagram of an example of a method.

FIG. 12 shows an example of a method 2100 that includes a fill block 2110 for filling a reservoir, a couple block 2120 for coupling the reservoir to a tubular extension, an actuation block 2130 for actuating a motor, and a control block 2140 for controlling a rotational scheme for rotating at least the reservoir. As an example, the method 2100 can include an adjustment block for adjusting gas pressure (e.g., before, at or after actuating the motor).

As an example, a method can include filling a reservoir offline by slowly pouring a material onto a side wall of the reservoir such that the material flows to a desired level. In such an example, the method can include inserting a barrel piston into the end of the reservoir and pushing the piston down with an end of finger, a pencil, a tool, etc., to purge gas that may be trapped in an end portion of the reservoir. For example, consider purging gas via a conduit at an end assembly (see, e.g., the coupling assembly 270, the coupling assembly 2270, etc.). As an example, a method can include degassing material after flowing the material into a reservoir.

As an example, a method can include tightening a reservoir to a tubular extension, which may be via a Luer type of mechanism that can lock the reservoir to the tubular extension.

As an example, a method can include actuating a motor to cause agitation of material in a reservoir where such a method can include adjusting slowly gas pressure until material starts to flow from the reservoir to a tubular extension (e.g., from a barrel of a syringe to a material transfer bridge). As an example, one or more components may include a window, be made of a transparent material, etc., such that flow of material can be visible to the human eye or to a machine vision system (e.g., camera, sensor, etc.). For example, a dispensing system may include a length of clear tubing between a tubular extension and a control valve body. After various preparation actions, a dispensing system can be in a ready to dispense state.

As an example, a dispensing system may include one or more controllers. For example, consider a speed controller that can be used to control the speed of a rotational mechanism.

As explained, a dispensing system may include one or more level sensors. For example, consider a material level detection sensor that can be used to detect a material level. In such an example, if the material level drops to or below a set level, agitation may be halted, optionally automatically, and one or more notifications may be issued as to re-filling, etc.

As an example, a dispensing system may include a fixed tilt angle or may include an adjustable tilt angle. For example, consider an adjustable tilt angle dispensing system that includes an adjustable bracket, which may be utilized to address bubble build up in material, effect of gravity, etc. As an example, where a flexible tube is utilized in a bridge (e.g., to bridge a tubular extension to a control valve body), the tilt angle may be adjusted in a manner that can cause bending of the flexible tube, where kinking may be avoided.

As an example, a dispensing system may include a tilt angle adjustment mechanism that can automatically adjust a tilt angle (e.g., responsive to a control signal, etc.).

As an example, an adjustable bracket can be utilized to achieve a desirable tilt angle for an agitation system. In such an example, with a slanting angle, bubble formation or trapped gas from filling tends to accumulate at a higher side of a reservoir, which can be at a tip of a piston. Re-filling may be performed in a manner where only material at the distal end a reservoir is affected, which can reduce risk of a dispensing system drawing a bubble into a passage, which can cause dripping.

As an example, a plug, which may be a plunger or piston, may be utilized to reduce backflow and wastage. As an example, a plug can be a wiper that can help to reduce undesirable fluid movements and provide for efficient wall-wiping. As an example, a plug may be configured to help prevent material from entering a conduit, etc., when turned upside down or slanted. As an example, a plug can help to ensure that extra gas does not enter and become trapped in material; noting that trapped gas can be discharged out when compression occurs.

As an example, a rotational mechanism for rotation of a reservoir for material agitation can help to reduce sedimentation and can be controllable using one or more rotational rates, directions, etc., which may be tailored for agitation of different characteristics. For example, consider different viscosity material and phosphor weight for LED production.

As an example, a reservoir may be oriented at a tilt angle of horizontal or greater than horizontal. As an example, a motor may be utilized to control one or more of rotational frequency, speed, direction of at least a reservoir. In such an example, the motor may be controlled to reduce sedimentation, segregation, dead zoning, etc., of material in the reservoir.

As an example, a dispensing system can provide for reservoir rotation and optionally rotation of a material bridge (e.g., a tubular extension, etc.), which may be rotated in unison.

As an example, the dispensing system 100 may be utilized for dispensing a material that includes phosphor for production of one or more light-emitting circuits such as, for example, a light-emitting diode (LED).

A phosphor is a substance that exhibits the phenomenon of luminescence. This includes both phosphorescent materials, which show a slow decay in brightness (>1 ms), and fluorescent materials, where emission decay can take place over tens of nanoseconds. Phosphorescent materials are known for their use in radar screens and glow-in-the-dark materials, whereas fluorescent materials are common in cathode ray tube (CRT) and plasma video display screens, fluorescent lights, sensors, and white LEDs. Phosphors are often transition-metal compounds or rare-earth compounds of various types.

Phosphorus has light-emitting behavior where light is emitted due to chemiluminescence. In inorganic phosphors, inhomogeneities in the crystal structure can be created by addition of a trace amount of one or more dopants, impurities referred to as activators; noting that dislocations or other crystal defects can play the role of the impurity. The wavelength emitted by the emission center depends on the atom itself and on the surrounding crystal structure.

The scintillation process in inorganic materials is due to the electronic band structure found in the crystals. An incoming particle can excite an electron from the valence band to either the conduction band or the exciton band (located just below the conduction band and separated from the valence band by an energy gap). Such a process leaves an associated hole behind, in the valence band. Impurities create electronic levels in the forbidden gap. The excitons are loosely bound electron-hole pairs that wander through the crystal lattice until they are captured as a whole by impurity centers. The latter then rapidly de-excite by emitting scintillation light (fast component). In the case of inorganic scintillators, the activator impurities may be chosen so that the emitted light is in the visible range or near-UV, where photomultipliers are effective. The holes associated with electrons in the conduction band are independent from the latter. Those holes and electrons are captured successively by impurity centers exciting certain metastable states not accessible to the excitons. The delayed de-excitation of such metastable impurity states, slowed down by reliance on the low-probability forbidden mechanism, again results in light emission (slow component).

Phosphor can be defined as a material that absorbs energy from one type of wavelength and that emits the energy at a different wavelength. For example, white LEDs can have a blue gallium nitride (GaN) semiconductor die, exciting a yellow phosphor coating, made from cerium doped yttrium aluminum garnet (YAG:Ce) powder dispersed in a gel or an adhesive such as a silicone adhesive. The result is the yellow light mixing with the unabsorbed blue light to produce a white light.

A phosphor particle size may in a range of approximately 2 microns to approximately 20 microns (e.g., diameter) with a specific gravity of approximately 4.5. Various phosphors can have a refractive index of approximately 1.7 to 2.3 for visible light. As an example, a dispersant may be used with phosphor such as barium titanate, titanium oxide or aluminum oxide.

As an example, a phosphor material may come in the form of a powder that can be dispersed into a silicone system (e.g., a silicone fluid, etc.), which may be a material that is used to encapsulate a die (e.g., at an approximately 30 percent level by weight, etc.). Silicone systems for phosphor dispersion can be tailored to generate various types of products with desired characteristics. As an example, a phosphor-silicone layer can be of the order of tens of microns in thickness (e.g., 10 microns or more). In various instances, a small variation in layer thickness in combination with inhomogeneous phosphor distribution in silicone can cause a noticeable, undesirable change in color of a LED, which can result in rejection (e.g., waste of relatively expensive dies).

Where a process includes dispensing of a mixture of phosphor particles in a silicone fluid, such a process can commence with a designed recipe in a reservoir; however, due to segregation, there can be an increased mixture density over time followed by a reduced density when material usage in the reservoir is near depletion.

In various instances, sedimentation in industrial fluid applications can become a more pronounced problem as efforts toward miniaturization progress, where dispensing sizes become smaller, resulting quite small rates of usage (e.g., dose volumes), which can increase time to consume material in a reservoir (e.g., a batch filled reservoir). As an example, in a miniaturized process, a dose to be delivered by a dispensing system may be of the order of hundredths of microliters or less (e.g., 0.10 microliter or less, etc.).

As to a rotation scheme, as an example, a rotation interval can be set at a time period in a range from approximately 20 seconds to 60 seconds for a rotate cycle. As an example, a higher frequency may result in a more uniform overall density of solids in a mixture (e.g., particles in fluid). However, rotation may introduce some amount of vibration, which can possibly affect a dispensing process. As an example, a motor may be a relatively vibration damped motor such that a ramp up and a ramp down occur to minimize introduction of vibrational energy.

The foregoing examples as to phosphor are to explain some aspects of what may be dispensed and how dispensing can impact product characteristics. As explained, a dispensing system that provides for material agitation via rotation of a tubular reservoir can improve product characteristics of a product where such material is dispensed during manufacture of the product.

As explained, the dispensing system 100 can include the material delivery assembly 160, which can include a tubular reservoir 200 with the tubular extension 300, wherein the tubular reservoir 200 is aligned along the longitudinal axis $z_p$; the nozzle body 180, where the tubular extension 300 fluidly couples the tubular reservoir 200 to the nozzle body 180; and a rotor coupling of the motor assembly 500 that operatively couples to the material delivery assembly 160 for rotation of the tubular reservoir 200 about its longitudinal axis $z_p$.

As an example, a dispensing system can include a material delivery assembly that includes a tubular reservoir with a tubular extension, where the tubular reservoir includes a longitudinal axis; a nozzle body, where the tubular extension fluidly couples the tubular reservoir to the nozzle body; and a rotor coupling that operatively couples to the material delivery assembly for rotation of the tubular reservoir about its longitudinal axis. In such an example, the nozzle body can include a nozzle that has a material dispensing axis, for example, consider an angle defined by the longitudinal axis of the tubular reservoir and an axis orthogonal to the material dispensing axis of the nozzle, where the angle is greater than or equal to 0 degrees (e.g., horizontal) and less than 90 degrees (e.g., vertical). In such an example, the angle may be less than 60 degrees. As an example, such an angle may be a side arm angle. For example, FIG. 1 shows the angle Θ as being a side arm angle, which is defined by a horizontal line that can be an axis that is orthogonal to the axis $z_d$, which can be a material dispensing axis of a nozzle. As explained, in operation, the dispensing system 100 of FIG. 1 can be oriented such that the axis $z_d$ is substantially aligned with the direction of the acceleration of gravity (e.g., vertical) where a side arm angle characterizes the axis $z_p$ of the material delivery assembly 160 (e.g., as measured from horizontal). In the example of FIG. 1, the side arm angle Θ is approximately 10 degrees. As an example, the side arm angle Θ may be equal to zero, approximately horizontal (e.g., +/−3 degrees), or may be, for example, approximately 60 degrees or less than approximately 60 degrees. As mentioned, a dispensing system may include an adjustable side arm angle, which may be manually, semi-automatically or automatically adjustable (see, e.g., FIGS. 9A, 9B, 9C, 9D, FIG. 11, etc.). As an example, an adjustable side arm angle may be adjustable over a range of angles, which may be from less than 0 degrees to 90 degrees or more (e.g., depending on configuration of a material bridge, whether a material bridge is coupled, etc.). For example, the dispensing system 2010 of FIG. 11 may provide for a range of angles of the tubular reservoir 2210 depending on one or more characteristics of the material bridge 2406, one or more coupling for the material bridge 2406, and/or whether the material bridge 2406 is coupled to one or more other components.

As an example, a dispensing system can include a motor operatively coupled to a rotor coupling where, for example, the dispensing system includes a controller operatively coupled to the motor.

As an example, a dispensing system can include a tubular extension that is fixed to a tubular reservoir for rotation about a longitudinal axis of the tubular reservoir.

As an example, a tubular reservoir can include a proximal end and a distal end where a fitting is operatively coupled to the proximal end of the tubular reservoir. For example, consider a Luer fitting. As an example, a tubular reservoir can include a plug and/or another component that is fit via a distal end of the tubular reservoir.

As an example, a tubular reservoir can be a tubular reservoir of a syringe.

As an example, a tubular reservoir can include a funnel defined in part by a funnel angle (e.g., a cone angle, etc.).

As an example, a method can include providing a dispensing system that includes a material delivery assembly that includes a tubular reservoir with a tubular extension, where the tubular reservoir includes a longitudinal axis; a nozzle body, where the tubular extension fluidly couples the tubular reservoir to the nozzle body; and a rotor coupling that operatively couples to the material delivery assembly for rotation of the tubular reservoir about its longitudinal axis; and actuating a motor that is operatively coupled to the rotor coupling to rotate the tubular reservoir about its longitudinal axis. In such an example, actuating can include rotating the tubular reservoir in a counter-clockwise or clockwise direction, halting rotation and then recommences rotation. As an example, actuating may rotate a tubular reservoir continuously for a rotational angle that is greater than 360 degrees. As an example, actuating may rotate a tubular reservoir continuously for a rotational angle that is less than 360 degrees.

As an example, a dispensing system controller can include an electronic motor interface; a control schedule for issuing one or more control signals via the electronic motor interface to actuate a motor to rotate a tubular reservoir a rotational angle in a clockwise or counter-clockwise direction, to then halt rotation of the tubular reservoir and to then rotate the tubular reservoir, which may be in the same direction or in an opposite direction, where the tubular reservoir is fluidly coupled to a nozzle body that includes a nozzle to dispense material from the tubular reservoir, where an angle is defined by a longitudinal axis of the tubular reservoir and an axis orthogonal to a material dispensing axis of the nozzle, where the angle is greater than or equal to 0 degrees and less than 60 degrees. In such an example, the material can include a mixture of particles of different sizes. As to direction of rotation, a sequence may rotate in a common direction or a sequence may rotate in opposing directions. As an example, a decision as to direction of rotation may be based on desired effect on a mixture that includes particles in a fluid where the fluid may be a gas, a liquid, a gel, etc. Where opposing directions are utilized, a motor may be utilized for rotating a tubular reservoir where the motor can be controlled to rotate in a first direction and in a second, opposing direction. As an example, such a motor may be a stepper motor. As mentioned, as an example, a stepper motor may be controllable to rotate with relative precision a number of degrees as part of a sequence (e.g., a cycle, etc.), which may be less than or equal to a single revolution (e.g., less than or equal to 360 degrees) or may be less than several revolutions (e.g., less than or equal to 3600 degrees). In such an example, a rotational speed may be less than 1000 rpm. For example, for 10 revolutions (e.g., approximately 3600 degrees), the time may be greater than approximately 0.6 seconds (e.g., a rotational speed less than 1000 rpm).

Although some examples of methods, devices, systems, arrangements, etc., have been illustrated in the accompanying Drawings and described in the foregoing Detailed Description, it will be understood that the example embodiments disclosed are not limiting, but are capable of numerous rearrangements, modifications and substitutions.

What is claimed is:

1. A dispensing system comprising:

a material delivery assembly that comprises a tubular reservoir with a tubular extension, wherein the tubular reservoir comprises a longitudinal axis, wherein the tubular extension comprises a tube that couples to the tubular reservoir, and wherein the tubular extension comprises a sleeve that receives the tube and that couples to the tube;

a nozzle body, wherein the tubular extension fluidly couples the tubular reservoir to a material bore of the nozzle body via a coupling assembly attached to the nozzle body, and wherein the nozzle body comprises a switching rod that selectively switches between a fill orientation to receive material from the material bore and a dispense orientation to dispense the material via a nozzle of the nozzle body; and a motor assembly that comprises a motor, a bearing that rotatably supports the tubular extension proximate to a coupling assembly end of the tubular extension, and a rotor coupling that operatively couples the motor to the tubular extension of the material delivery assembly for rotation of the tubular extension to rotate, in unison, the tubular reservoir about the longitudinal axis.

2. The dispensing system of claim 1, wherein the nozzle comprises a material dispensing axis.

3. The dispensing system of claim 2, comprising an angle defined by the longitudinal axis of the tubular reservoir and an axis orthogonal to the material dispensing axis of the nozzle, wherein the angle is greater than or equal to 0 degrees and less than 90 degrees.

4. The dispensing system of claim 3, wherein the angle is less than 60 degrees.

5. The dispensing system of claim 1, comprising a controller operatively coupled to the motor.

6. The dispensing system of claim 1, wherein the tubular reservoir comprises a proximal end and a distal end and comprising a fitting at the proximal end of the tubular reservoir that couples the tube to the tubular reservoir.

7. The dispensing system of claim 1, wherein the tubular reservoir comprises a tubular reservoir of a syringe.

8. The dispensing system of claim 1, wherein the tubular reservoir comprises a funnel defined in part by a funnel angle.

9. A method comprising:

providing a dispensing system that comprises:

a material delivery assembly that comprises a tubular reservoir with a tubular extension, wherein the tubular reservoir comprises a longitudinal axis, wherein the tubular extension comprises a tube that couples to the tubular reservoir, and wherein the tubular extension comprises a sleeve that receives the tube and that couples to the tube;

a nozzle body, wherein the tubular extension fluidly couples the tubular reservoir to a material bore of the nozzle body via a coupling assembly attached to the nozzle body, and wherein the nozzle body comprises a switching rod that selectively switches between a fill orientation to receive material from the material bore and a dispense orientation to dispense the material via a nozzle of the nozzle body; and a motor assembly that comprises a motor, a bearing that rotatably supports the tubular extension proximate to a coupling assembly end of the tubular extension, and a rotor coupling that operatively couples the motor to the tubular extension of the material delivery assembly for rotation of the tubular extension to rotate, in unison, the tubular reservoir about its longitudinal axis; and actuating the motor to rotate the tubular reservoir about its longitudinal axis.

10. The dispensing system of claim 5, wherein the controller comprises:

an electronic motor interface; and a control schedule for issuing one or more control signals via the electronic motor interface to actuate the motor to rotate the tubular reservoir a rotational angle in a clockwise or counter-clockwise direction, to then halt rotation of the tubular reservoir and to then rotate the tubular reservoir in the same direction or in an opposite direction, wherein an angle is defined by a longitudinal axis of the tubular reservoir and an axis orthogonal to a material dispensing axis of the nozzle, wherein the angle is greater than or equal to 0 degrees and less than 60 degrees.

11. The dispensing system of claim 1, wherein the nozzle comprises a material dispensing axis and wherein the longitudinal axis of the tubular reservoir is disposed at a fixed angle with respect to the material dispensing axis.

12. The dispensing system of claim 1, comprising a pivot mechanism that defines a pivot axis, wherein the tubular reservoir is pivotable about the pivot axis to define an angle of the tubular reservoir with respect to the nozzle body.

13. The dispensing system of claim 12, wherein at least a portion of the tubular extension is bendable between the tubular reservoir and the nozzle body.

14. The dispensing system of claim 12, wherein the tubular extension is pivotable with the tubular reservoir.

15. The dispensing system of claim 1, wherein the rotor coupling comprises a drive belt.

16. The dispensing system of claim 15, wherein the tubular reservoir comprises a receptacle for coupling and removably de-coupling the tubular reservoir from the tube of the tubular extension without de-coupling the drive belt from the tubular extension.

17. The dispensing system of claim 1, comprising a level sensor that indicates a level or levels of material in the tubular reservoir.

18. The dispensing system of claim 1, wherein the bearing rotatably supports the sleeve.

19. The dispensing system of claim 1, wherein the motor comprises a motor axis that is parallel to and offset a distance from a rotational axis of the tubular extension.

20. The dispensing system of claim 18, wherein the sleeve is coupled to the tube and the tube is coupled to the tubular reservoir, rotation of the sleeve rotates the tube and the tubular reservoir.

* * * * *